US007387472B2

(12) United States Patent
Abella

(10) Patent No.: US 7,387,472 B2
(45) Date of Patent: Jun. 17, 2008

(54) SYSTEM OF BRICK WITH ROD FOR RETAINING WALL

(75) Inventor: Ricardo Enrique Abella, Cali (CO)

(73) Assignee: John J. Martinez, Croton on Hudson, NY (US)

( * ) Notice: Subject to any disclaimer, the term of this patent is extended or adjusted under 35 U.S.C. 154(b) by 0 days.

(21) Appl. No.: 11/520,060

(22) Filed: Sep. 12, 2006

(65) Prior Publication Data

US 2008/0047218 A1 Feb. 28, 2008

(51) Int. Cl.
*E02D 29/02* (2006.01)

(52) U.S. Cl. ..... 405/284; 52/604

(58) Field of Classification Search ..... 52/600, 52/604, 606; 405/284
See application file for complete search history.

(56) References Cited

U.S. PATENT DOCUMENTS 4,996,813 A * 3/1991 Kliethermes et al. ..... 52/592.1
5,312,858 A * 5/1994 Folsom ..... 524/435
7,114,887 B1 * 10/2006 Rainey ..... 405/262

FOREIGN PATENT DOCUMENTS

JP 04146330 A * 5/1992
JP 2001241055 A * 9/2001

* cited by examiner

*Primary Examiner*—John Kreck
(74) *Attorney, Agent, or Firm*—Martinez Patents PC; John J. Martinez

(57) ABSTRACT

The invention of the present application provides a system of brick and rod for the construction of inclined walls, with great rigidity and lateral resistance, and great resistance to extreme uniform, cyclic, and gravitational forces. The brick of this system is a block with horizontal and vertical protuberances and cavities which permits horizontal and vertical interlocks with the adjacent bricks of the wall. The brick is also perforated by holes that are aligned with the holes of the vertically adjacent bricks of the wall, thus forming continuous holes which go throughout the entire height of the wall. The rods of the system cross the bricks through the continuous holes of the wall. This system allows the construction of an inclined wall made of bricks reinforced with a skeleton of rods. The resulting wall is suitable for retaining walls.

9 Claims, 21 Drawing Sheets

SYSTEM OF BRICK WITH ROD FOR RETAINING WALL

BACKGROUND OF THE INVENTION

1. Field of the Invention

The present invention is related to the field of construction of inclined walls with bricks which interlock horizontally and vertically.

In the field of the present invention, walls have been described that are constructed with bricks having protuberances and cavities which interlock horizontally and vertically with the objective of reducing the use of adhesives or mortar. Bricks with protuberances and cavities which interlock horizontally and vertically have also been described with the aim of constructing walls with high lateral resistance to uniform and cyclic forces of nature. However, a system of bricks and rods has not been described for the construction of inclined walls in which there are no need for adhesive or mortar, which results in walls with great rigidity and lateral resistance, and great resistance to extreme uniform, cyclic and gravitational forces.

2. Description of Prior Art

In the prior art construction of walls have been described using bricks with protuberances and cavities that interlock horizontally and vertically resulting in walls in which the use of adhesive or mortar is reduced, with high resistance to uniform and cyclic forces of nature.

Specifically, Nanayakkara describes in his patents, U.S. Pat. No. 6,550,208 B2 (Apr. 22, 2003), U.S. Pat. No. 6,105,330 (Aug. 22, 2000), y U.S. Pat. No. 6,578,338 B1 (Jun. 17, 2003), bricks or blocks with a system of horizontal and vertical interlocks, with reduction in the use of mortar, resulting in walls with high lateral resistance to natural uniform and cyclic forces. U.S. Pat. No. 6,550,208 B2 describes a brick having external positive and negative geometries that are complementary, and a continuous vertical cavity, resulting in horizontal and vertical interlocks between adjacent bricks for construction of walls which would have continuous vertical cavities.

The Nanayakkara's patents do not describe a brick or block like the one described in the system of brick with rod of the present invention. The brick or block described in Nanayakkara's patents is not adequate for inclined walls. Nanayakkara does not describe a brick with perforations or holes that are specifically adapted to the diameter of a rod which function is to reinforce the interlocks formed by the protuberances and cavities of the horizontally and vertically adjacent bricks of a wall.

The inventor of the present invention, in the Colombia Patent Application No. 06-049234 (May 23, 2006), which is incorporated herein in its entirety by reference, describes a brick with perforations or holes that are specifically adapted to the diameter of rods which function is to reinforce the interlocks formed by the protuberances and cavities of the horizontally and vertically adjacent bricks of a wall.

However, in the prior art, there has not been described a system of brick with rod that allows the construction of inclined walls. The system of brick with rod of the present invention permits the construction of inclined walls, as for example, retaining walls with great rigidity and lateral resistance, and great resistance to extreme uniform, cyclic and gravitational forces.

DESCRIPTION OF THE INVENTION

The present invention provides a system of brick and rod, wherein the system is characterized by a rectangular tridimensional brick to build walls, wherein the brick is defined by the three Cartesian coordinates X, Y, Z, wherein the horizontal axis X defines length, the vertical axis Y defines height, the horizontal axis Z defines width, and wherein the brick is a solid block comprising:

a. a superior horizontal surface and a inferior horizontal surface defined by the X and Z axis;

b. a vertical anterior surface and a vertical posterior surface defined by the Z and Y axis;

c. two vertical lateral surfaces defined by the X and Y axis;

d. a protuberance of positive geometry that is originated on the brick's vertical anterior surface in direction of the X axis, and with an axis between the superior horizontal surface and the inferior horizontal surface with an inclination angle between 1° and 45° in relation to the Y axis, wherein said protuberance interlocks precisely with an horizontally adjacent block with the cavity described in e.;

e. a cavity of negative geometry that is originated on the brick's vertical posterior surface in direction of the X axis, and with an axis between the superior horizontal surface and the inferior horizontal surface with an inclination angle between 1° and 45° in relation to the Y axis, wherein said cavity interlocks precisely with an horizontally adjacent brick with the protuberance described in d.;

f. two protuberances of positive geometry located on the brick's superior horizontal surface in direction of an axis with an inclination angle between 1° and 45° in relation to the Y axis, wherein said protuberances interlock precisely with vertically adjacent blocks with the cavities described in g.;

g. two cavities of negative geometry located symmetrically on the inferior horizontal surface in direction of an axis with an inclination angle between 1° and 45° in relation to the Y axis, wherein said cavities interlock precisely with vertically adjacent blocks with the protuberances described in f.;

h. two cylindrical holes which perforate entirely the brick, wherein the span of said holes, in direction of an axis with an inclination angle between 1° and 45° in relation to the Y axis, is defined from the positive geometry superior border of the protuberances described in f. to the negative geometry superior border of the cavities described in g.; and wherein these holes and the identical holes of vertically adjacent brick's in a wall are aligned in direction of an axis with an equal inclination angle in the wall, to form inclined continuous holes that go throughout the height of the wall; and wherein said holes have a diameter which fits the diameter of a rod such that the rod can be introduced through the continuous hole that goes throughout the height of the wall;

and wherein resistant interlocks are created between vertically and horizontally adjacent bricks to build an inclined wall which allows the introduction of an skeleton constituted by a plurality of rods thus resulting in a structure with great rigidity and lateral resistance, and great resistance to extreme uniform, cyclic and gravitational forces.

In one further aspect of the present invention, the brick has two additional holes, wherein the first of these two additional holes is a cylindrical hole which perforates entirely the brick, wherein the span of the first additional hole, in direction of an axis with an inclination angle between 1° and 45° in relation to the Y axis, is defined from the brick's superior horizontal surface to the brick's inferior horizontal surface; and wherein the first additional hole is located in parallel between the two holes described in h.; and wherein the second of these two additional holes is a vertical cylindrical hole which perforates entirely, in direction of an axis with an inclination angle between 1° and 45° in relation to the Y axis, the protuberance described in d., wherein the span of the second additional hole is defined from the center of said protuberance's superior horizontal surface to the center of said protuberance's inferior horizontal surface; and wherein the first additional hole and the second additional hole are of equal diameter, and wherein the first additional hole and the second additional hole of vertically adjacent bricks are aligned in direction of an axis with an equal inclination axis in a wall, to form an inclined continuous hole that goes throughout the height of a the wall; and wherein these two additional holes have a diameter that fits the diameter of a rod such that the rod can be introduced through the continuous hole that goes throughout the height of the wall.

In another aspect of the present invention, the system is characterized by a rod, wherein the span of the rod is equal or exceeds the span of the wall's height; and wherein the rod is vertically introduced through the continuous holes of the wall.

In another aspect of the present invention, the system is characterized by a rod, wherein the rod is a composed rod that comprises rod fragments wherein each rod fragment's span is equal to one and a half times the span of the brick's height, and wherein each rod fragment is formed by three parts defined as first part, second part and a third part; wherein the three parts have exactly the same span such that each part has a span equal to one third the span of the rod fragment; wherein the first part is at one rod fragment's end; and wherein the first part is hollow with internal thread thus constituting the part that functions as female screw of the rod fragment; and wherein the second part is the middle of the rod fragment between the first part and the third part; and wherein the second part is solid; and wherein the third part is solid with external thread; and wherein the third part is located at the end opposite to the end constituted by the first part; and wherein the third part is the part that functions as male screw of the rod fragment; and wherein the first part of a rod fragment interlocks with the third part of another identical rod fragment, and wherein a plurality of identical rod fragments that have successively been interlocked form the composed rod.

In another aspect of the present invention, the system is characterized by a rod, wherein the rod is a composed rod that comprises rod fragments wherein each rod fragment's span is equal to one and a half times the span of the brick's height, and wherein each rod fragment is formed by three parts defined as first part, second part and a third part; wherein the three parts have exactly the same span such that each part has a span equal to one third the span of the rod fragment; wherein the first part is at one rod fragment's end; and wherein the first part is hollow with an internal diameter that fits the external diameter of the third part; and wherein the first part is the female part of the rod fragment; and wherein the second part is in the middle of the rod fragment between the first part and the third part; and wherein the second part is solid; and wherein the third part is solid with an external diameter that fits the internal diameter of the first part; and wherein the third part is located at the end opposite to the end constituting the first part; and wherein the third part is the male part of the rod fragment; and wherein the first part of a rod fragment interlocks with the third part of another identical rod fragment, and wherein a plurality of identical rod fragments that have successively been interlocked form the composed rod.

In a second version of the present invention, the brick is characterized by a symmetrical protuberance of positive geometry that is originated in the middle of the brick's vertical anterior surface in direction of the X axis, wherein said protuberance interlocks precisely with a horizontally adjacent block with the cavity of the posterior vertical surface.

In another aspect of the second version of the present invention, the brick is characterized by a symmetrical cavity of negative geometry that is originated in the middle of the brick's vertical posterior surface in direction of the X axis, wherein said cavity interlocks precisely with a horizontally adjacent block with the protuberance of the brick's vertical anterior surface.

In an additional aspect of the second version of the present invention, the brick is characterized by two protuberances of positive geometry located on the brick's superior horizontal surface in direction of the Y axis, wherein said protuberances interlock precisely to vertically adjacent blocks with the cavities of the inferior horizontal surface.

In one further aspect of the second version of the present invention, the brick is characterized by two cavities of negative geometry located on the inferior horizontal surface in direction of the Y axis, wherein said cavities interlock precisely with vertically adjacent blocks with the protuberances of the superior horizontal surface.

In another aspect of the second version of the present invention, the brick is characterized by two cylindrical holes that perforate entirely the brick, wherein the span of said holes, in direction of an axis with an inclination angle between 1° and 45° in relation to the Y axis, is defined from the border of the protuberances' positive geometry of the superior horizontal surface to the border of the cavities' negative geometry of the inferior horizontal surface; and wherein these holes and the identical holes of the vertically adjacent bricks in a wall are aligned in direction of an axis with an equal inclination angle in the wall, to form continuous inclined holes that go throughout the height of the wall; and wherein said holes have a diameter that fits the diameter of a rod such that the rod can be introduced trough the continuous hole that goes throughout the height of the wall;

and wherein resistant interlocks are created between the vertically and horizontally adjacent bricks to build a wall that allows the introduction of a skeleton constituted by a plurality of rods thus resulting in a structure with great rigidity and lateral resistance, and great resistance to extreme uniform, cyclic, and gravitational forces.

In a third version of the present invention, the brick is a tridimensional block to build walls, wherein the block is characterized by two lateral vertical surfaces defined by the X and Y axis; wherein the first lateral vertical surface is a convex surface; and wherein the second vertical lateral surface is a concave surface; and wherein the first lateral surface and the second lateral surface are parallel.

In one aspect of the third version of the present invention, the brick is characterized by a symmetrical protuberance of positive geometry that is originated in the middle of the brick's vertical anterior surface in direction of the X axis, wherein said protuberance interlocks precisely with a horizontally adjacent block with the cavity of the vertical posterior surface.

In another aspect of the third version of the present invention, the brick is characterized by a cavity of negative geometry that is originated in the middle of the brick's vertical posterior surface in direction of the X axis, wherein said cavity interlocks precisely with a horizontally adjacent brick with the protuberance of the vertical anterior surface.

In another additional aspect of the third version of the present invention, the brick is characterized by two protuberances of positive geometry located symmetrically in the middle of the brick's superior horizontal surface in direction of the Y axis, wherein said protuberances interlock precisely with vertically adjacent blocks with the cavities of the inferior horizontal surface.

In another further aspect of the third version of the present invention, the brick is characterized by two cavities of negative geometry located symmetrically on the middle of the inferior horizontal surface in direction of the Y axis, wherein said cavities interlock precisely with vertically adjacent blocks with the protuberances of the superior horizontal surface.

In another aspect of the third version of the present invention, the brick is characterized by two vertical cylindrical holes that perforate entirely the brick, wherein the span of said holes, in direction of the Y axis, is defined from the superior border of the protuberances' positive geometry on the superior horizontal surface to the superior border of the cavities' negative geometry on the inferior horizontal surface; and wherein these holes and identical holes of the vertically adjacent bricks in a wall are aligned in direction of the vertical axis in the wall to form continuous vertical holes that go throughout the height of the wall;

and wherein resistant interlocks are created between vertically and horizontally adjacent bricks to build a wall with great rigidity and lateral resistance, and great resistance to extreme uniform, cyclic and gravitational forces.

In another further aspect of the third version of the present invention, the brick is characterized by two vertical cylindrical holes that perforate entirely the brick, wherein the span of said holes, in direction of the Y axis, is defined from the superior border of the protuberances' positive geometry on the superior horizontal surface to the superior border of the cavities' negative geometry on the inferior horizontal surface; and wherein these holes and identical holes of the vertically adjacent bricks in a wall are aligned in direction of the vertical axis in the wall to form vertical continuous holes that go throughout the height of the wall; and wherein said holes have a diameter that fits the diameter of identical rods such that the rods can be introduced trough the continuous holes that go throughout the height of the wall; and wherein resistant interlocks are created between vertically and horizontally adjacent bricks to build a wall that allows the introduction of a skeleton constituted by a plurality of vertical rods; and wherein said wall is a structure with great rigidity and lateral resistance, and great resistance to extreme uniform, cyclic and gravitational forces.

In another further aspect of the third version of the present invention, the brick is characterized by two additional holes, wherein the first of these two additional holes is a cylindrical hole that perforates entirely the brick, wherein the span of the first additional hole, in direction of the Y axis, is defined from the brick's superior horizontal surface to the brick's inferior horizontal surface; and wherein the first additional hole is located in parallel between the two holes that go from the protuberances of the superior horizontal surface to the cavities of the inferior horizontal surface; and wherein the second of these two additional holes is a vertical cylindrical hole that perforates entirely, in direction of the Y axis, the protuberance of the vertical anterior surface, wherein the span of the second additional hole is defined from the center of the superior horizontal surface of the protuberance of the vertical anterior surface, to the center of the inferior horizontal surface of the protuberance of the vertical anterior surface; and wherein the first additional hole and the second additional hole have equal diameter, and wherein the first additional hole and the second additional hole of vertically adjacent bricks are aligned in direction of a vertical axis in a wall, to form a continuous vertical hole that goes throughout the height of the wall; and wherein these two additional holes have a diameter that fits the diameter of identical rods such that the rods can be introduced trough the continuous holes that go throughout the height of the wall; an wherein resistant interlocks are created between vertically and horizontally adjacent bricks to build a wall that allows the introduction of a skeleton constituted by a plurality of vertical rods; and wherein said wall is a structure with great rigidity and lateral resistance, and great resistance to extreme uniform, cyclic and gravitational forces.

In another further aspect of the third version of the present invention, the brick is characterized by a 90 degree right angle channel on the two edges, in direction of the Y axis, of the vertical anterior surface; a 90 degree right angle channel on the two edges, in direction of the Y axis, of the vertical posterior surface, a 90 degree right angle channel on the two edges, in direction of the X axis, of the superior horizontal surface; and a 90 degree right angle on the two edges, in direction of the X axis, of the inferior horizontal surface.

Objectives and additional advantages of the present invention will become more evident in the description of the figures, the detailed description of the invention and the claims.

DETAILED DESCRIPTION OF THE INVENTION

Figure 1:
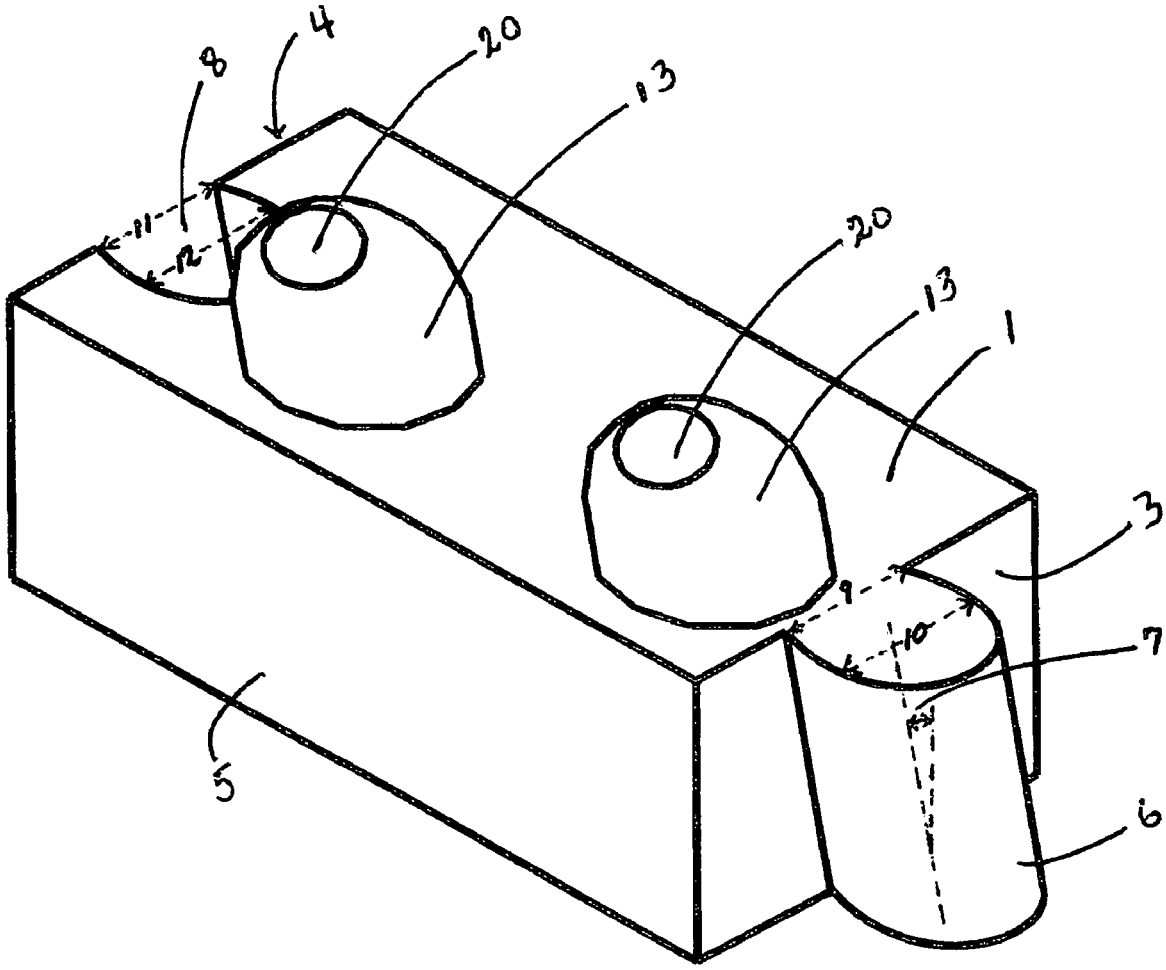
FIG. 1. is a tridimensional view of one embodiment of the brick of the present invention.
Figure 2:
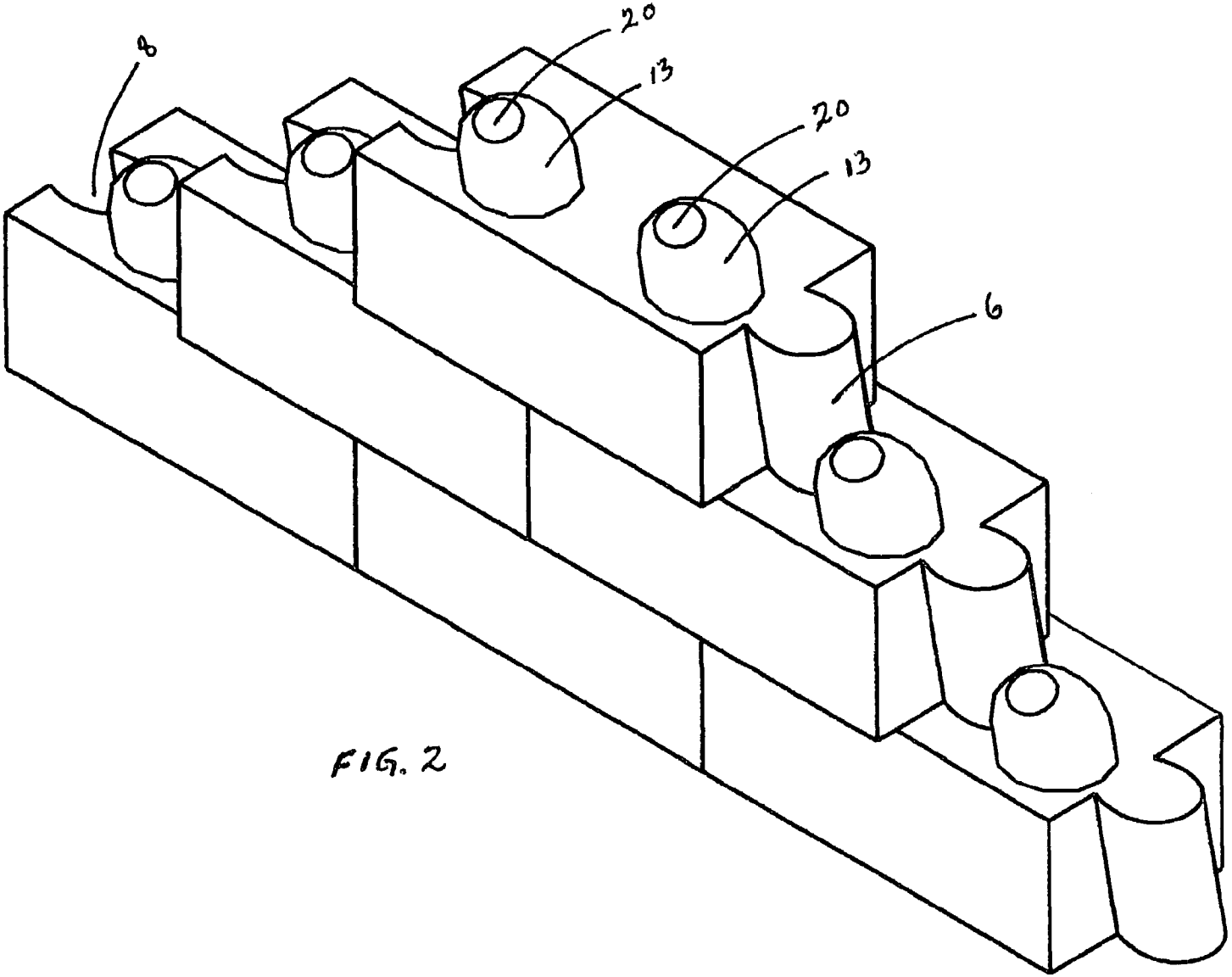
FIG. 2. is a tridimensional view of one embodiment of the brick of the present invention, in which bricks interlocked vertically and horizontally are observed.
Figure 4:
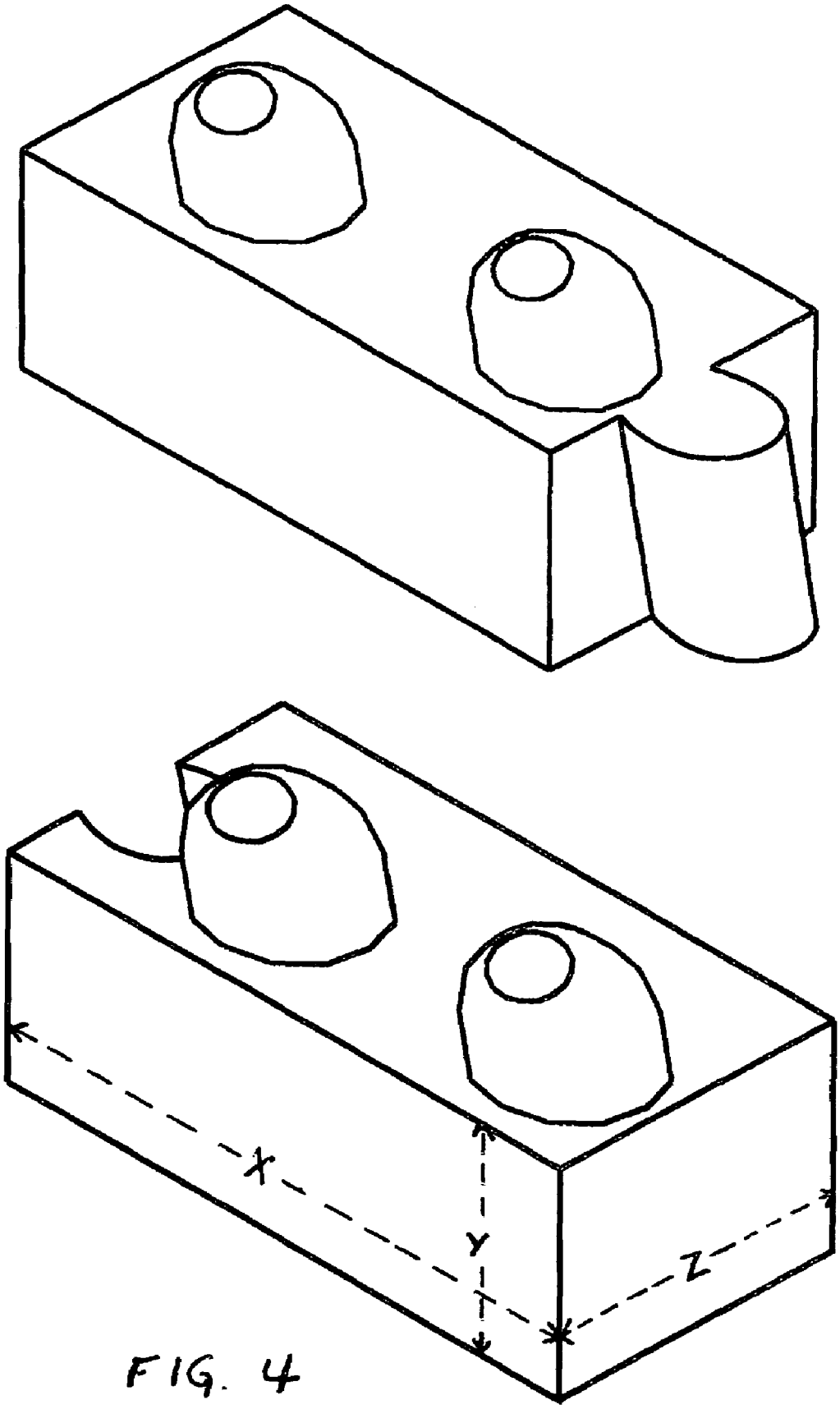
FIG. 4. is a tridimensional view of two embodiments of the brick of the present invention.
Figure 5:
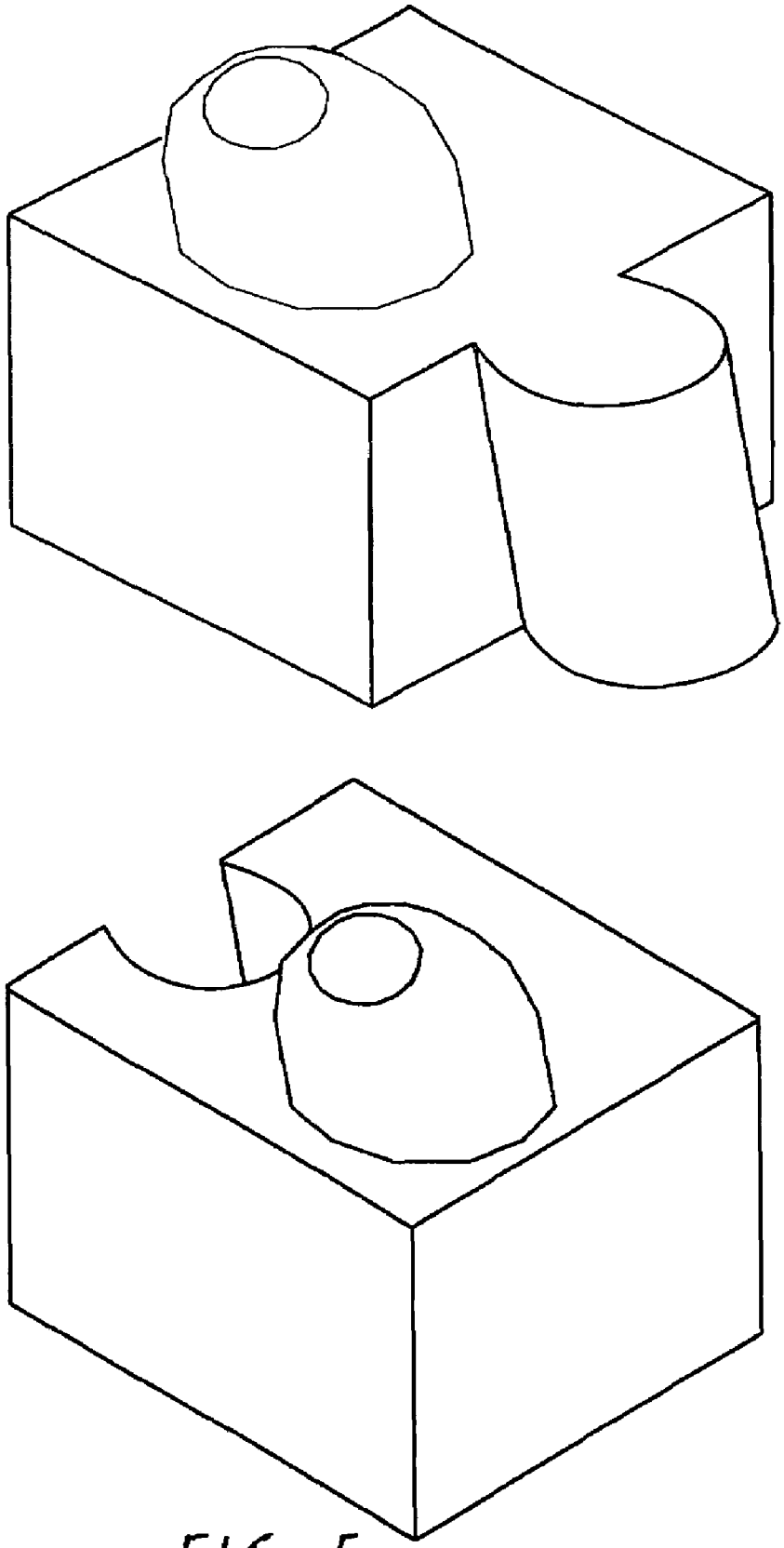
FIG. 5. is a tridimensional view of two embodiments of the brick of the present invention.

FIG. 1. shows a tridimensional view of an embodiment of the brick of the present invention. The brick is defined, as it is shown in FIG. 4., by the three Cartesian coordinates X, Y, Z, wherein the horizontal axis X defines length, the vertical axis Y defines height, the horizontal axis Z defines width.

The brick has a superior horizontal surface (1) (FIGS. 1. y 3.), a inferior horizontal surface (2) (FIG. 3.), a vertical anterior surface (3) (FIG. 1.), a vertical posterior surface (4) (FIG. 1.), and two lateral vertical surfaces (5) (FIGS. 1. y 3.).

In FIG. 1. shows the first version of the present invention in which it is observed a protuberance of positive geometry (6) that is originated on the brick's vertical anterior surface (3) in direction of the X axis, and with an axis between the superior horizontal surface (1) and the inferior horizontal surface (2) with an inclination angle (7) between 1° and 45° in relation to the Y axis, wherein said protuberance interlocks precisely with a horizontally adjacent block with the cavity (8) of the vertical posterior surface (4).

The positive geometry of the protuberance can be any appropriate geometrical form. The preferred positive geometry, as it is observed in FIG. 1., is represented by a protuberance of rounded-convex geometry (6) that is originated on the brick's vertical anterior surface (3) in direction of the X axis, and with an axis between the superior horizontal surface and the inferior horizontal surface with an inclination angle (7) between 1° and 45° in relation to the Y axis, wherein said protuberance interlocks precisely with a horizontally adjacent block with the cavity (8) of the vertical posterior surface (4); and wherein the base (9) of the protuberance in the brick's vertical anterior surface (3), defined in the same direction of the Z axis, is of shorter span than the maximum diameter (10) of the convex geometry of the protuberance (6).

FIG. 1. also shows a cavity of negative geometry (8) that is originated on the brick's posterior vertical surface (4) in direction of the X axis, and with an axis between the superior horizontal surface (1) and the inferior horizontal surface (2) (FIG. 3.), with an inclination angle between 1° and 45° in relation to the Y axis, and wherein said cavity (8) interlocks precisely with a horizontally adjacent block with the protuberance (6) of the vertical anterior surface (3).

The negative geometry of the cavity (8) can be any appropriate geometry form. The preferred negative geometry, as it is observed in FIG. 1., is represented by a cavity of concave geometry (8) that is originated on the brick's posterior vertical surface (4) in direction of the X axis, and with an axis between the superior horizontal surface (1) and the inferior horizontal surface (2) with an inclination angle between 1° and 45° in relation to the Y axis, and wherein said cavity (8) interlocks precisely with a horizontally adjacent block with the protuberance (6) of the vertical anterior surface (3); and wherein the span of the aperture (11) of the cavity (8) on the brick's vertical posterior surface (4), defined in the same direction of the Z axis, is less than the maximum diameter (12) of the concave geometry of the cavity (8).

FIG. 1. shows the two protuberances (13) of positive geometry located on the brick's superior horizontal surface (1) in direction of an axis with an inclination angle (14) (FIG. 3.) between 1° and 45° in relation to the Y axis, wherein said protuberances (13) interlock precisely with vertically adjacent blocks with the cavities (17) (FIG. 3.) of the inferior horizontal surface (2).

The positive geometry of the protuberances (13) can be any appropriate geometry form. The preferred positive geometry, as it is observed in FIG. 1., is represented by two protuberances (13) of convex-cylindrical geometry located on the brick's superior horizontal surface (1) in direction of an axis with an inclination angle (14) between 1° and 45° in relation to the Y axis, wherein said protuberances (13) interlock precisely with vertically adjacent blocks with the cavities (17) of the inferior horizontal surface (2); and wherein the diameter (15) (FIG. 3.) of the base of each protuberance (13) on the brick's superior horizontal surface (1) is equal to the diameter (16) (FIG. 3.) of the cylindrical part of the protuberance (13).

Figure 3:
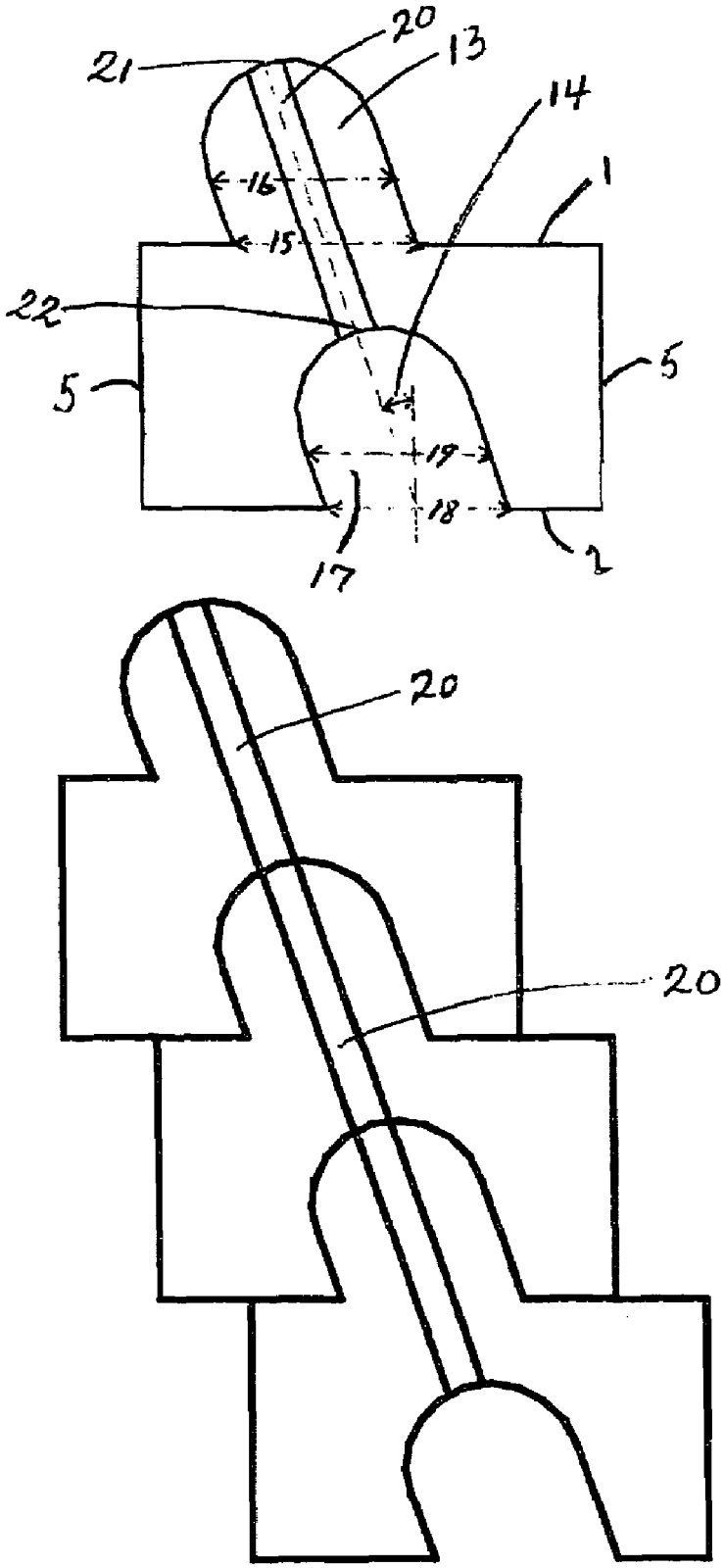
FIG. 3. is a view of a bi-dimensional plane of the brick of the present invention, In which a sagittal plane at the level of the inclined holes of the brick is observed.

FIG. 3. shows one of the two cavities (17) with negative geometry located symmetrically on the inferior horizontal surface (2) in direction of an axis with an inclination angle (14) between 1° and 45° in relation to the Y axis, wherein said cavities (17) interlock precisely with vertically adjacent blocks with the protuberances (13) of the superior horizontal surface (1).

The negative geometry of the cavities (13) can be any appropriate geometry form. The preferred negative geometry, as it is observed in FIG. 3., is represented by a cavity (17) with concave-cylindrical geometry located symmetrically on the inferior horizontal surface (2) in direction of an axis with an inclination angle (14) between 1° and 45° in relation to the Y axis, wherein said cavities (17) interlock precisely with vertically adjacent blocks with the protuberances (13) of the superior horizontal surface (1); and wherein the aperture's diameter (18) of each cavity (17) on the brick's inferior horizontal surface (2) is equal to the diameter (19) of the cylindrical part of the cavity (17).

FIGS. 1. and 3. show two cylindrical holes (20) that perforate entirely the brick, wherein the span of said holes (20), in direction of an axis with an inclination angle (14) (FIG. 3.) between 1° and 45° in relation to the Y axis, is defined from the superior border (21) (FIG. 3.) of the positive geometry of the protuberances (13) of the superior horizontal surface (1) to the superior border (22) (FIG. 3.) of the negative geometry of the cavities (17) of the inferior horizontal surface (2); and wherein these holes (20) and the identical holes (20) (FIG. 3.) of the vertically adjacent bricks in a wall are aligned in direction of an axis with an equal inclination angle in the wall, to form continuous inclined holes that go throughout the height of the wall; and wherein said holes have a diameter that fits the diameter of a rod such that the rod can be introduced through the continuous hole that goes throughout the height of the wall; and wherein resistant interlocks are created between the horizontally and vertically adjacent bricks to build an inclined wall that allows the introduction of an skeleton constituted by a plurality of rods thus resulting in a structure with great rigidity and lateral resistance, and great resistance to extreme uniform, cyclic and gravitational forces.

Figure 6:
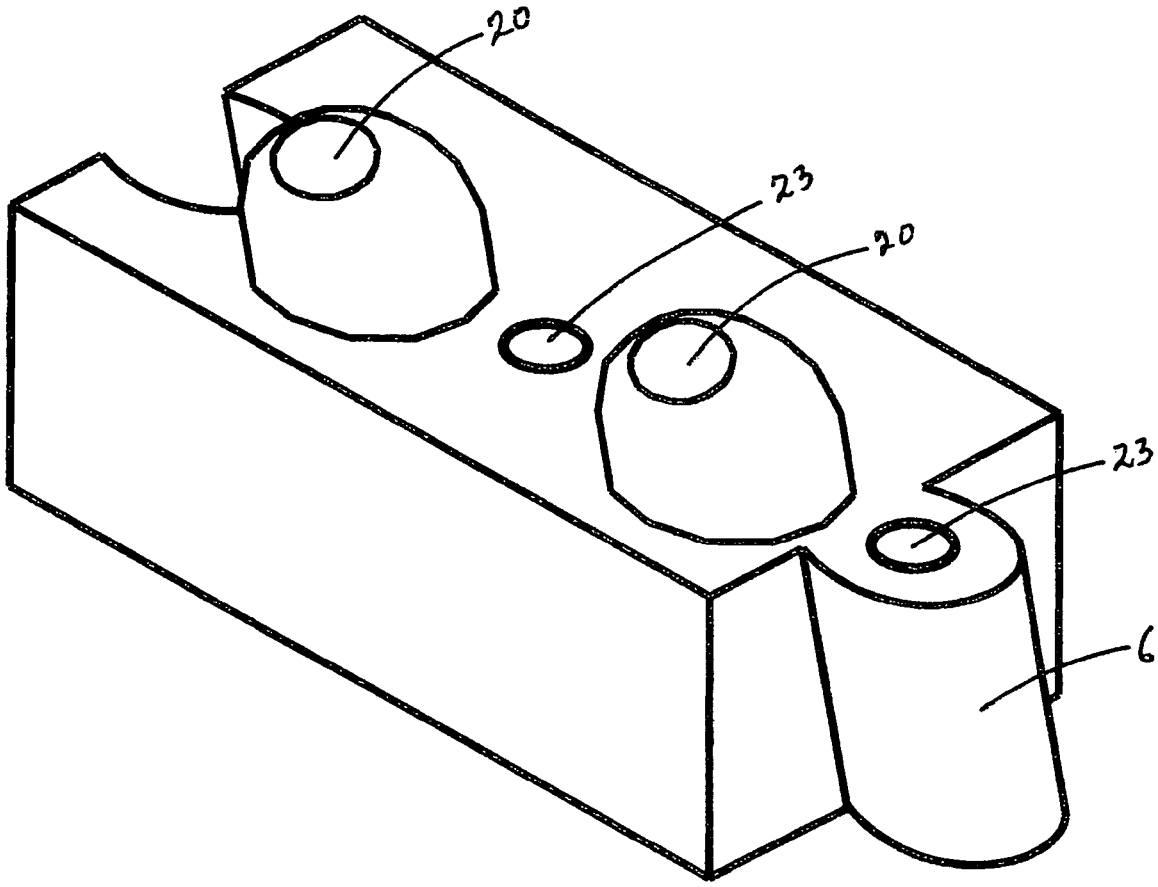
FIG. 6. is a tridimensional view of one embodiment of the brick of the present invention.

In FIG. 6. two additional holes (23) can be observed, wherein the first of these two additional holes (23) is a cylindrical hole that perforates entirely the brick, wherein the span of the first additional hole (23), in direction of an axis with an inclination angle between 1° and 45° in relation to the Y axis, is defined from the brick's superior horizontal surface (1) to the brick's inferior horizontal surface (2); and wherein the first additional hole (23) is located in parallel between the two holes (20) that go from the protuberance (13) of the superior horizontal surface (1) to the cavity of inferior horizontal surface (2); and wherein the second of these additional holes (23) is a cylindrical hole that perforates entirely, in direction of an axis with an inclination angle between 1° and 45° in relation to the Y axis, the protuberance (6) of the vertical anterior surface (3), wherein the span of the second additional hole (23) is defined from the center of the superior horizontal surface (1) of said protuberance (6) to the center of the inferior horizontal surface (2) of said protuberance (6); and wherein the first additional hole (23) and the second additional hole (23) are of equal diameter, and wherein the first additional hole (23) and the second additional hole (23) of vertically adjacent bricks are aligned in direction of an axis with an equal inclination angle in a wall, to form a continuous inclined hole that goes throughout the height of the wall; and wherein these two additional hole have a diameter that fits the diameter of a rod such that the rod can be introduced trough the continuous hole that goes throughout the height of the wall.

Figure 16:
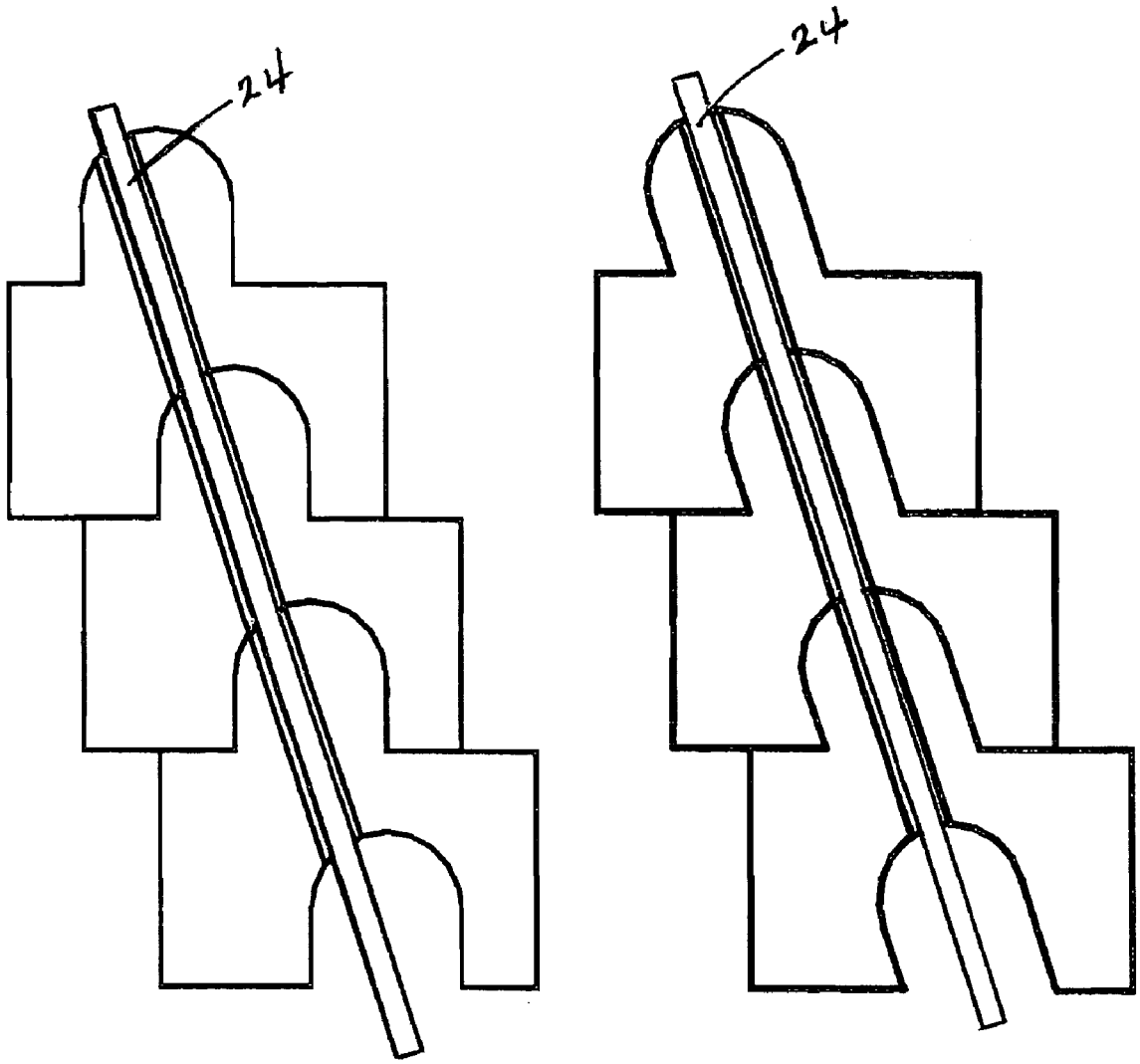
FIG. 16. shows a view of a bi-dimensional plane of the first and second version of the system of brick with rod of the present invention, in which three bricks interlocked vertically with rods that go through the continuous inclined holes can be observed.

In FIG. 16. a rod representation (24) of the present invention is observed, wherein the span of the rod (24) is equal or exceeds the span of the wall's height; and wherein the rod (24) is introduced through the continuous holes of the wall.

Figure 7:
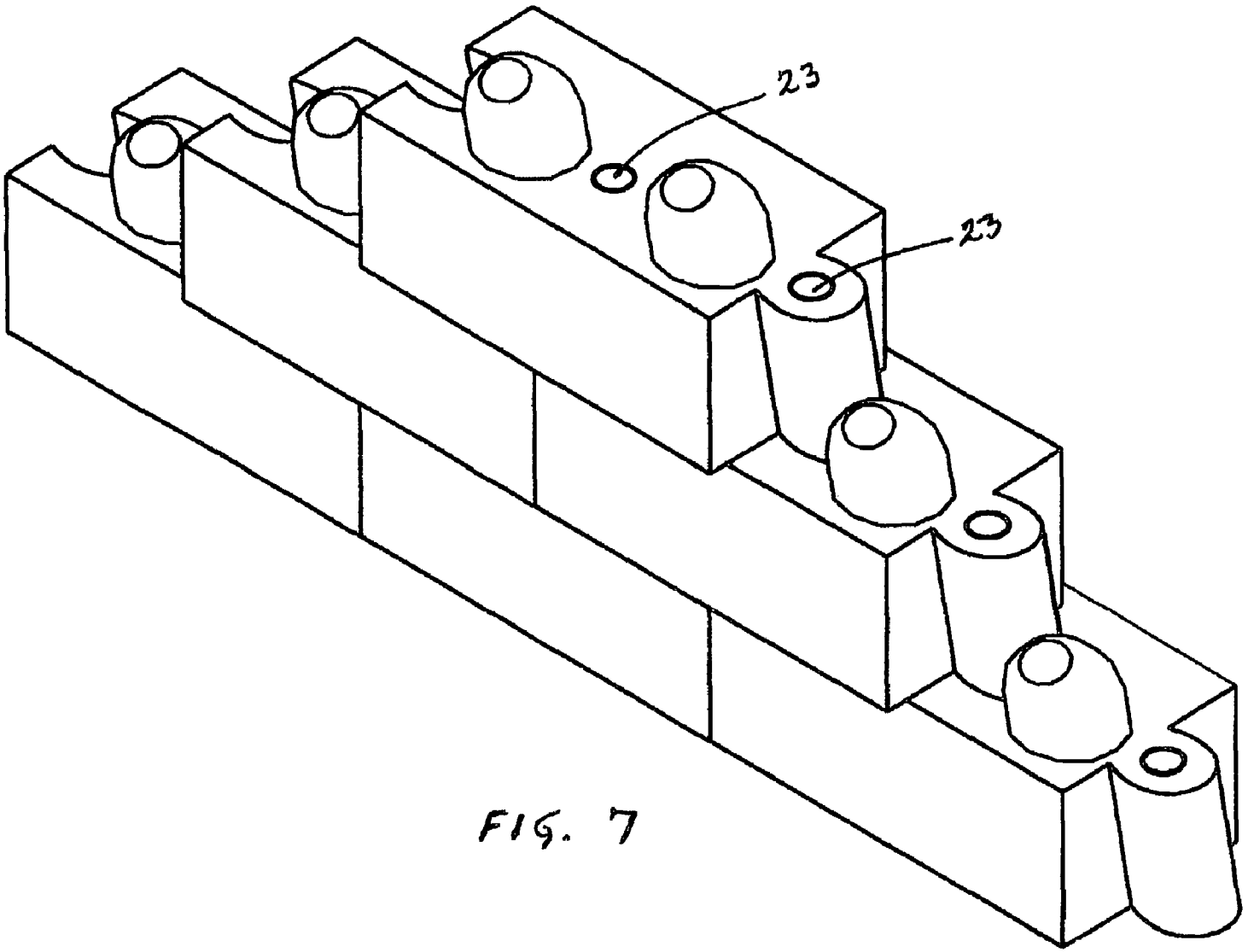
FIG. 7. is a tridimensional view of one embodiment of the brick of the present invention, in which bricks interlocked vertically and horizontally are observed.
Figure 7A:
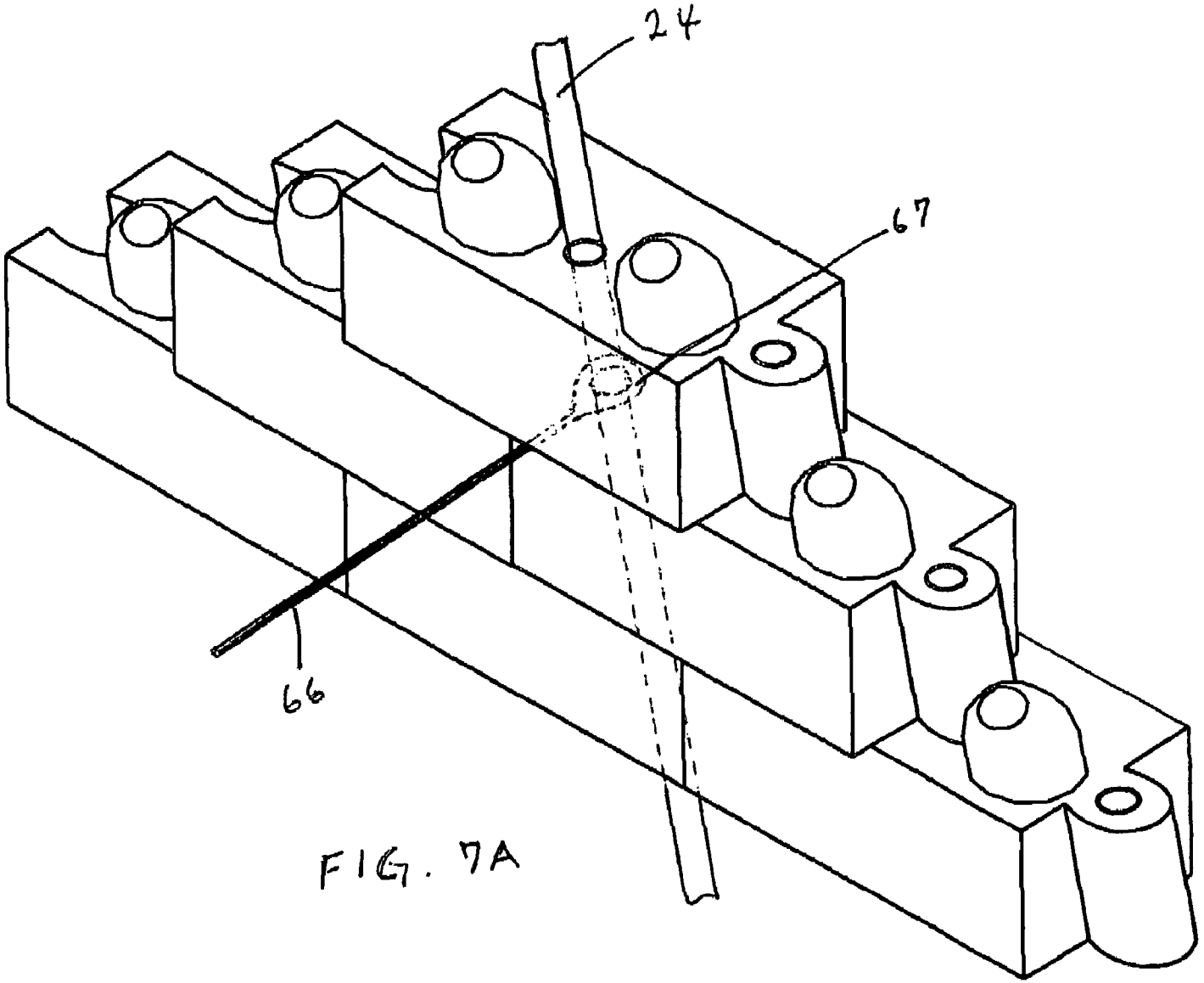
FIG. 7A is a tridimensional view of an embodiment of brick of the present invention, in which bricks interlocked vertically and horizontally are observed; wherein a rod going through the height of a wall is also seen; and wherein the rod is attached to a cable which function is to anchor the wall.
Figure 8:
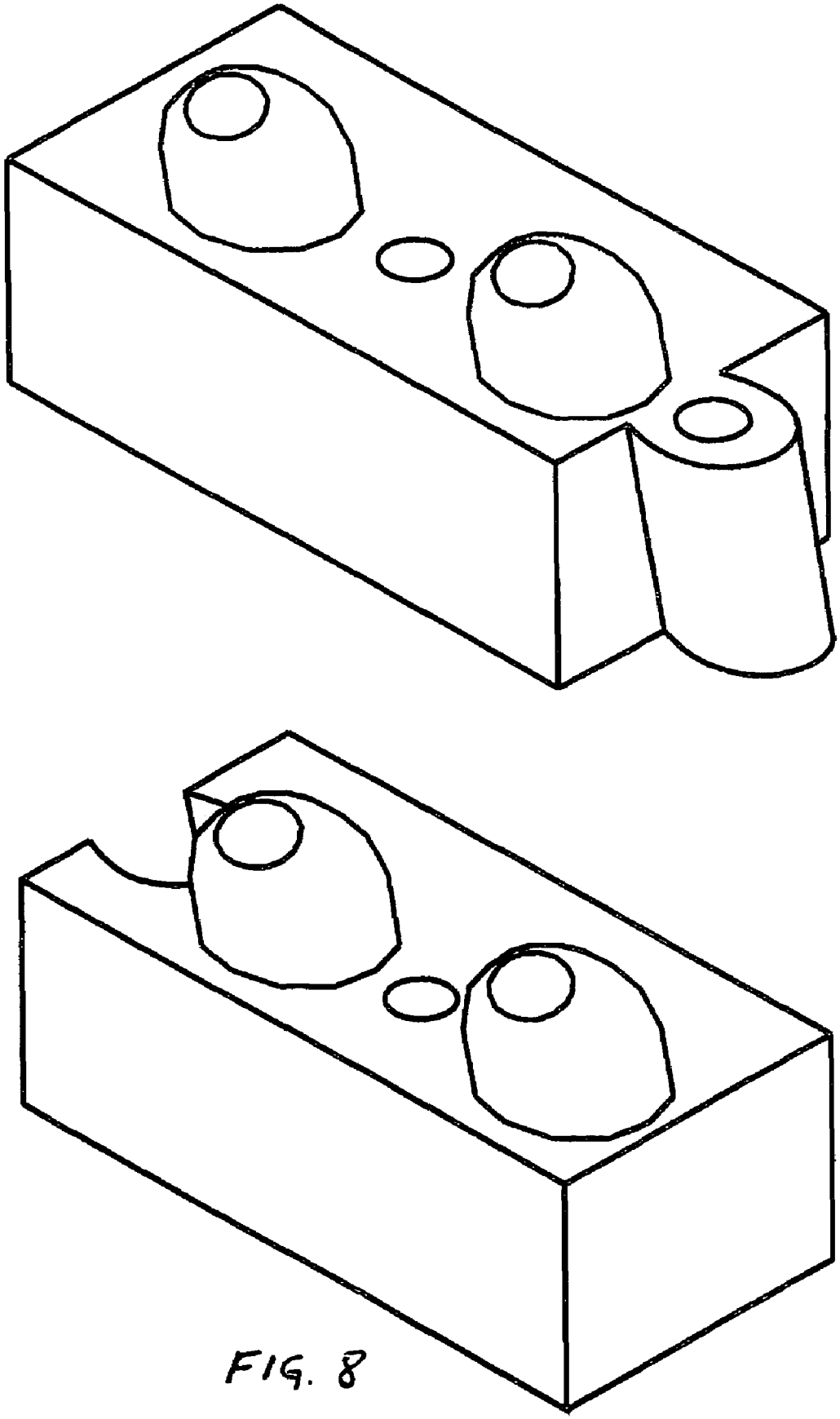
FIG. 8. is a tridimensional view of two embodiments of the brick of the present invention.
Figure 9:
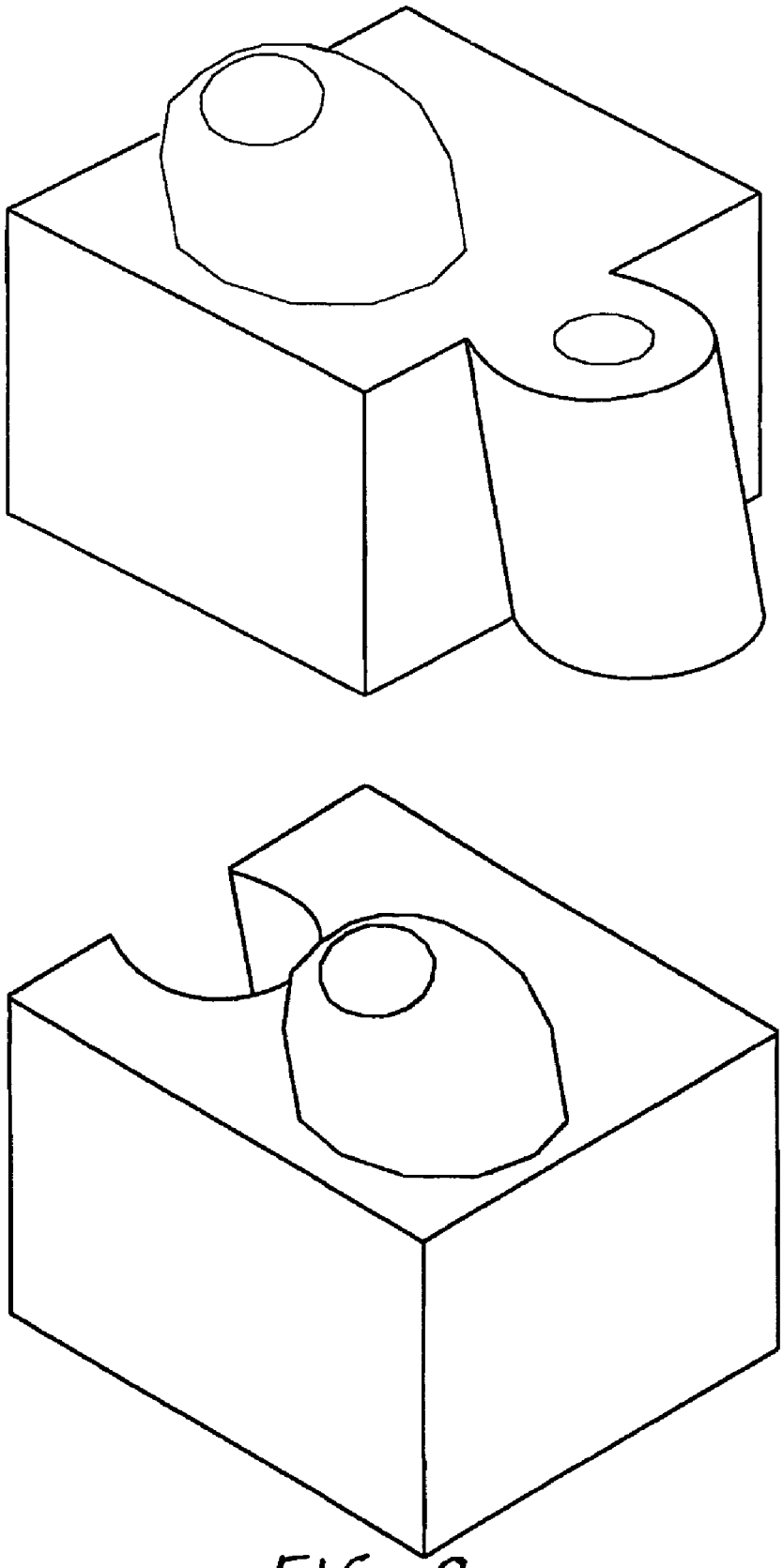
FIG. 9. is a tridimensional view of two embodiments of the brick of the present invention.

The rod (24) of the present invention can also be used to anchor the wall with a cable as it is observed in FIG. 7A., wherein the cable (66) has an adapter (67) between two vertically adjacent bricks. The adapter can have different mechanisms to hold to the wall. The adapter could hold to the exterior of the wall by a T termination. The adapter can also hold to the wall by a orifice that fits to one of the protuberances of the superior horizontal surface. In a preferred embodiment, said adapter (67) has a hole that fits to the diameter of the rod (24).

The rod (24) can be a composed rod formed by more than one rod fragment. One of the preferred versions of the present invention is represented in FIG. 15. which shows rod fragments (26), where the span of each rod fragment is equal to one and a half times the span of the brick's height, and wherein each rod fragment is formed by three parts defined as first part (26A), second part (26B) and a third part (26C); wherein the three parts have exactly the same span such that each part has a span equal to one third of the span of the rod fragment; and wherein the first part (26A) is at one end of the rod fragment; and wherein the first part (26A) is hollow with internal thread thus constituting the part that functions as female screw of the rod fragment; and wherein the second part (26B) is in the middle of the rod fragment between the first part (26A) and the third part (26C); and wherein the second part (26B) is solid; and wherein the third part (26C) is solid with external thread; and wherein the third part (26C) is located at the end opposite to the end constituted by the first part (26A); and wherein the third part (26C) is the part that functions as the male screw of the rod fragment; and wherein the first part (26A) is interlocked to the third part (26C) of another identical rod fragment, and wherein a plurality of identical rod fragments that have been successively interlocked form the composed rod (24) (FIG. 16.).

Figure 15:
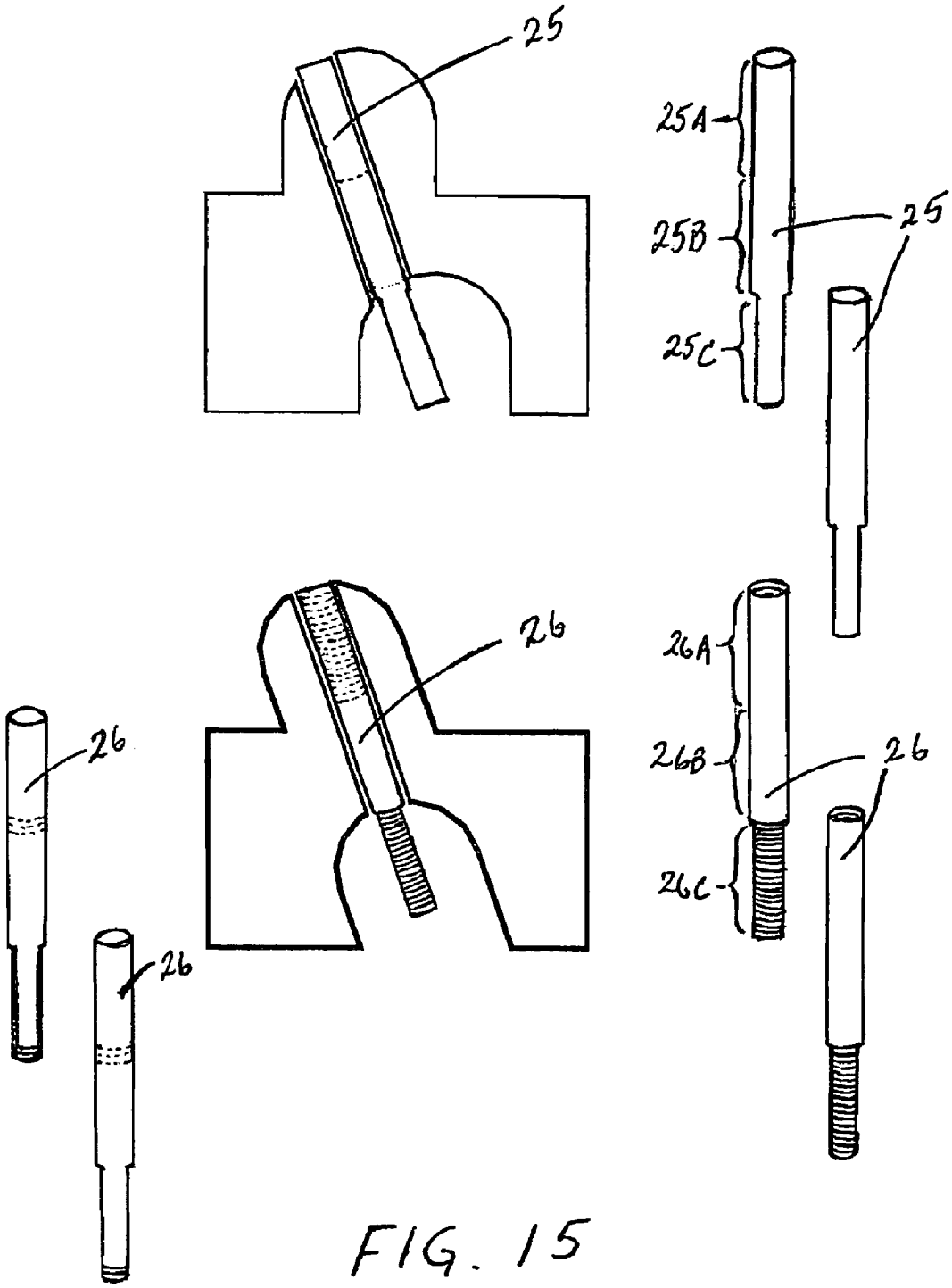
FIG. 15. shows a bi-dimensional view of the first and second version of the system of brick with rod of the present invention, in which a sagittal plane at the level of the inclined holes of the brick can be observed. This figure also shows tridimensional representations of three versions of fragment rods of the present invention.

In FIG. 15. rod fragments (25) are also observed wherein the span of each rod fragment is equal to one and a half times the span of the brick's height, and wherein each rod fragment is formed by three parts defined as first part (25A), second part (25B) and a third part (25C); wherein the three parts have exactly the same span such that each part has a span equal to one third of the span of the rod fragment; and wherein the first part (25A) is at one end of the rod fragment; and wherein the first part (25A) is hollow with an internal diameter that fits the external diameter of the third part (25C); and wherein the first part (25A) is the female part of the rod fragment; and wherein the second part (25B) is in the middle of the rod fragment between the first part (25A) and the third part (25C); and wherein the second part (25B) is solid; and wherein the third part (25C) is solid with an external diameter that fits the internal diameter of the first part (25A); and wherein the third part (25C) is located at the end opposite to the end constituted by the first part (25A); and wherein the third part (25C) is the part that functions as the male part of the rod fragment; and wherein the first part (25A) is interlocked to the third part (25C) of another identical rod fragment, and wherein a plurality of identical rod fragments that have been successively interlocked form the composed rod (24) (FIG. 16.).

Figure 10:
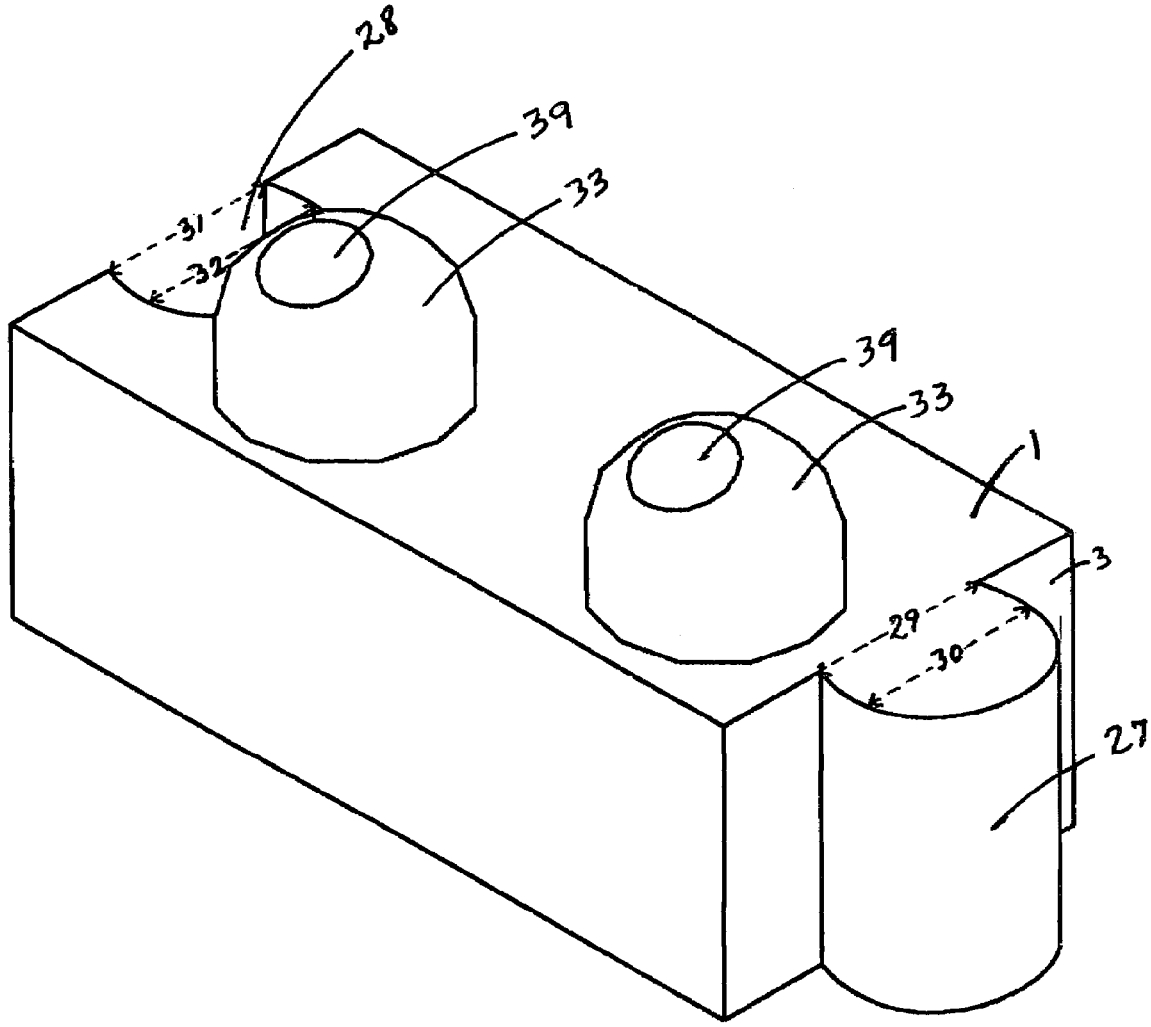
FIG. 10. is a tridimensional view of the second version of the brick of-the present invention.
Figure 11:
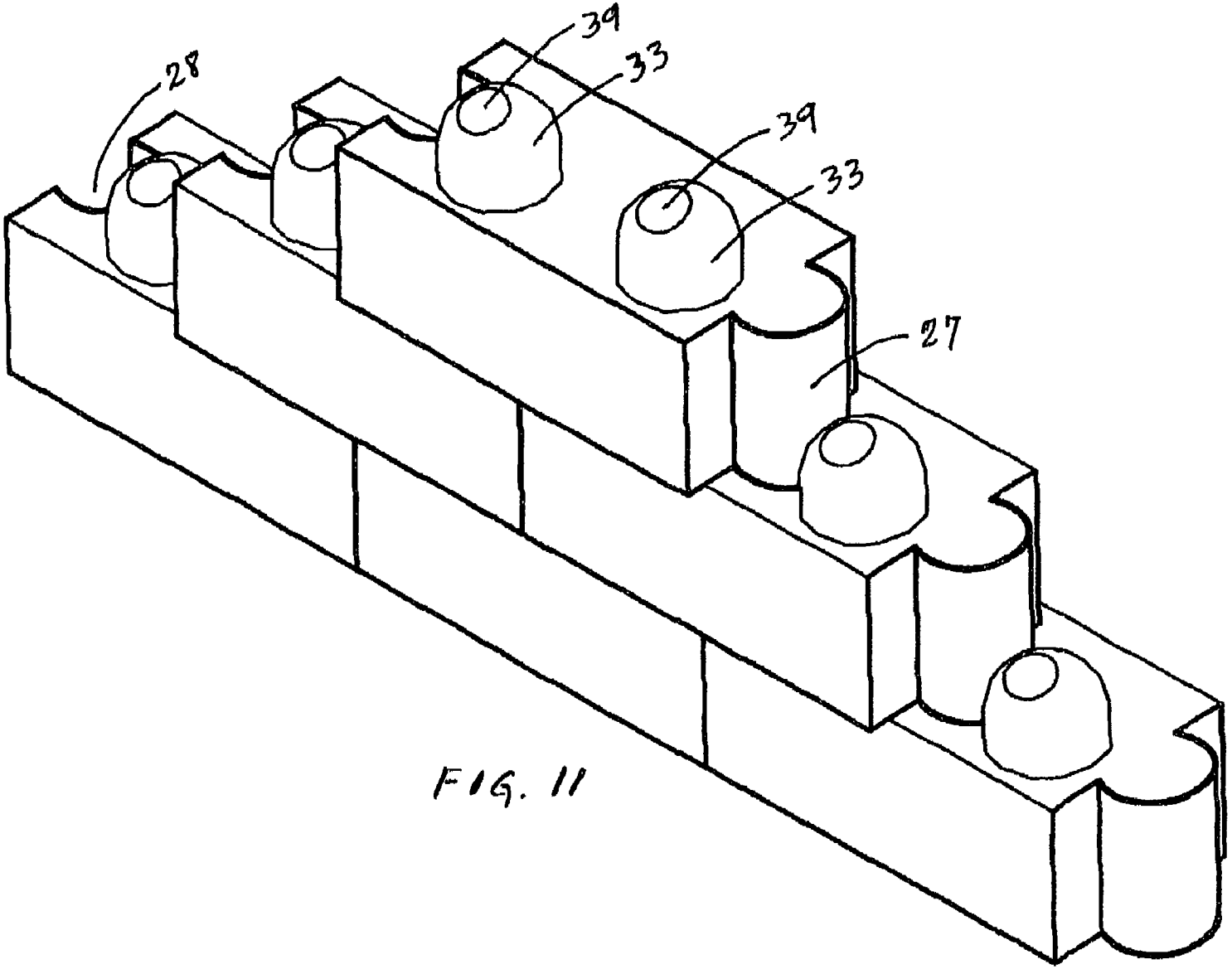
FIG. 11. is a tridimensional view of the second version of the brick of the present invention, in which bricks interlocked vertically and horizontally are observed.

In FIG. 10. the second version of the present invention is observed, in which the brick is characterized by a protuberance (27) of positive geometry that is originated on the middle of the brick's vertical anterior surface (3) in direction of the X axis, wherein said protuberance (27) interlocks precisely with a horizontally adjacent block with the cavity (28) of the vertical posterior surface (4).

The positive geometry of the protuberance (27) can be any appropriate geometry form. The preferred positive geometry, as it is observed in FIG. 10., is represented by a protuberance (27) of rounded convex geometry that is originated on the middle of the brick's vertical anterior surface (3) in direction of the X axis, wherein said protuberance (27) interlocks precisely with a horizontally adjacent block with the cavity (28) of the vertical posterior surface (4); and wherein the base (29) of the protuberance (27) of the brick's vertical anterior surface (3), defined in the same direction of the Z axis, is of minor span than the maximum diameter (30) of the convex geometry of the protuberance (27).

FIG. 10. also shows another aspect of the second version of the present invention in which the brick is characterized by a symmetrical cavity (28) of negative geometry that is originated on the middle of the brick's vertical posterior surface (4) in direction of the X axis, wherein said cavity (28) interlocks precisely with an horizontally adjacent block with the protuberance (27) of the vertical anterior surface (3).

The negative geometry of the cavity (28) can be any appropriate geometry form. The preferred negative geometry, as it is observed in FIG. 10., is represented by a symmetrical cavity (28) of concave geometry that is originated on the middle of the brick's vertical posterior surface (4) in direction of the X axis, wherein said cavity (28) interlocks precisely with an horizontally adjacent block with the protuberance (27) of the vertical anterior surface (3); and wherein the span (31) of the aperture of the cavity (28) on the brick's vertical posterior surface (4), defined in the same direction of the Z axis, is less than the maximum diameter (32) of the concave geometry of the cavity (28).

In FIGS. 10. and 12. another additional aspect of the second version of the present invention is also observed, in which the brick is characterized by two protuberances (33) of positive geometry located on the brick's superior horizontal surface (1) in direction of the Y axis, wherein said protuberances (33) interlock precisely with vertically adjacent blocks with the cavities (34) (FIG. 12.) of the inferior horizontal surface (2).

The positive geometry of the protuberances (33) can be any appropriate geometry form. The preferred positive geometry, as it is observed in FIGS. 10. and 12., is represented by a two protuberances (33) of convex-cylindrical geometry located on the brick's superior horizontal surface (1) in direction of the Y axis, wherein said protuberances (33) interlock precisely with vertically adjacent blocks with the cavities (34) of the inferior horizontal surface (2); and wherein the diameter (35) (FIG. 12.) of the base of each protuberance (33) on the brick's superior horizontal surface (1) is equal to the diameter (36) (FIG. 12.) of the cylindrical part of the protuberance (33).

Figure 12:
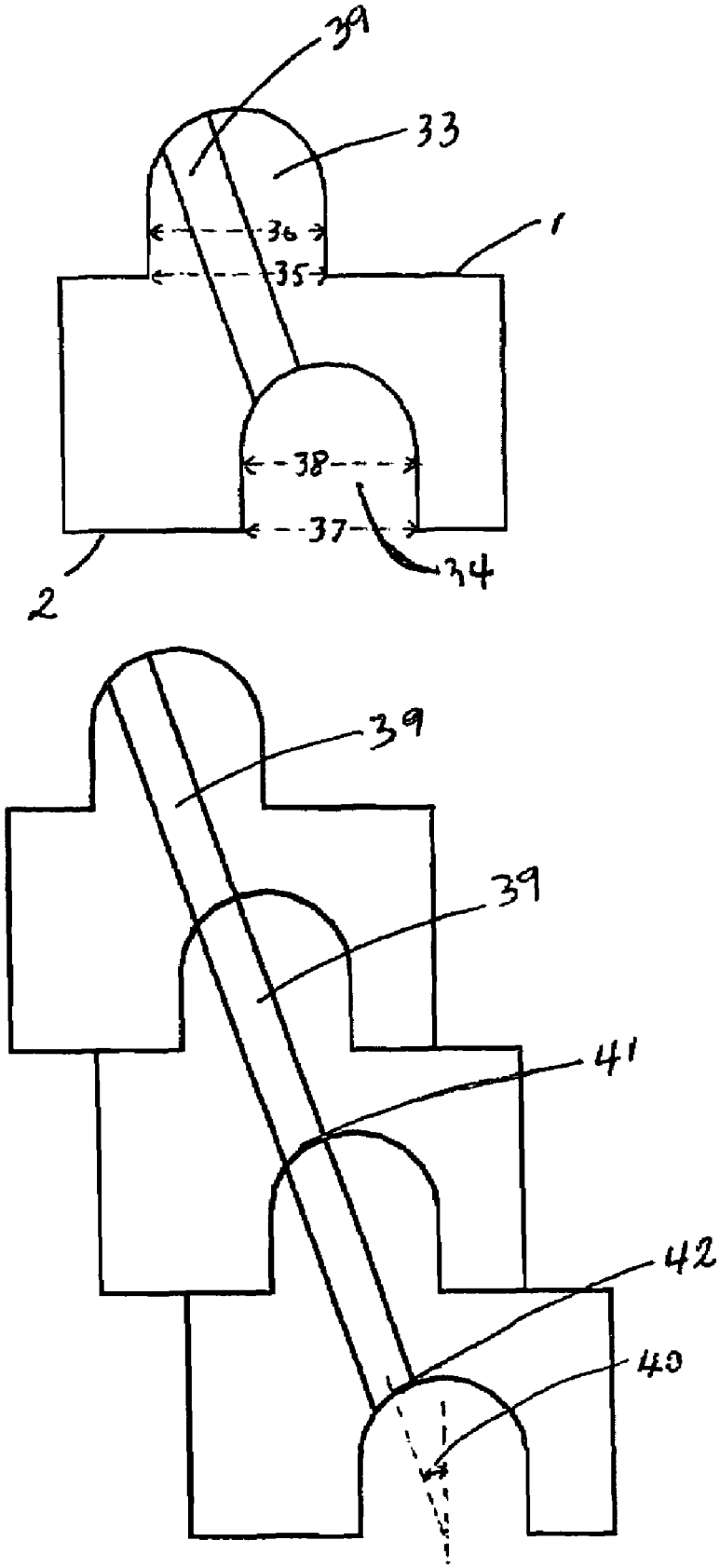
FIG. 12. is a view of bi-dimensional plane of the second version of the brick of the present invention, in which a sagittal plane at the level of the inclined holes of the brick is observed.
Figure 13:
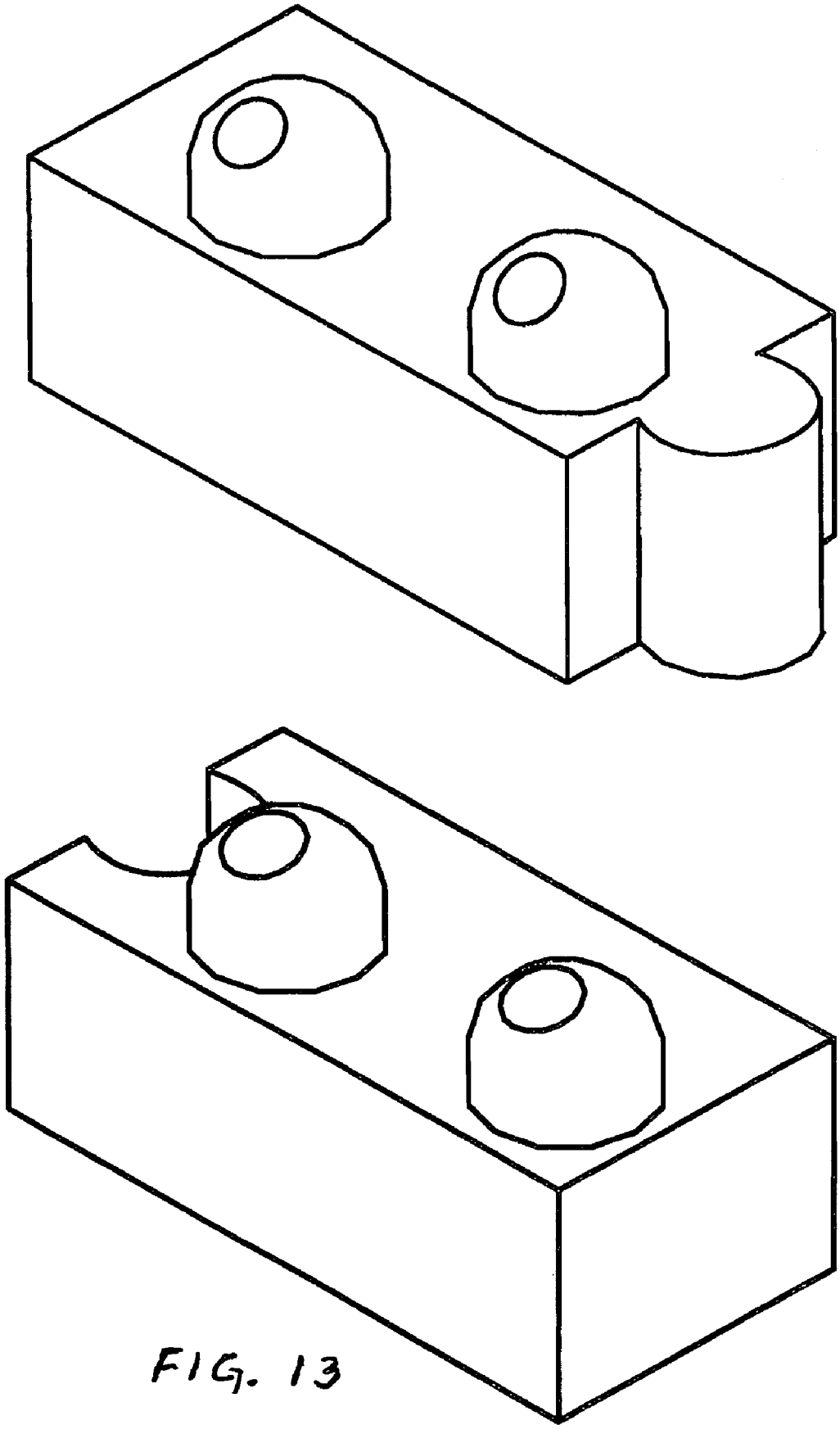
FIG. 13. is a tridimensional view of two embodiments of the second version of the brick of the present invention.
Figure 14:
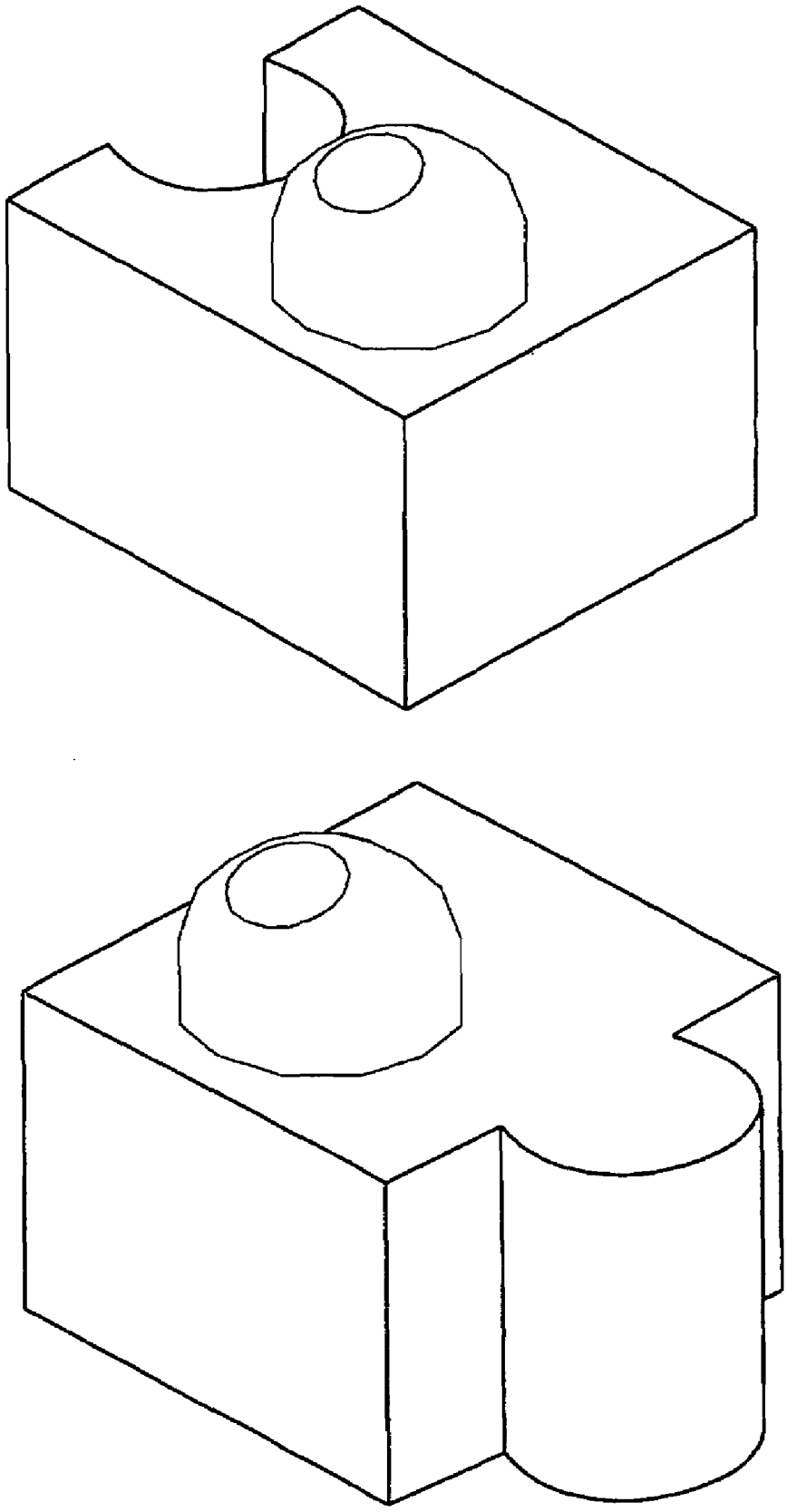
FIG. 14. is a tridimensional view of two embodiments of the second version of the brick of the present invention.

In FIG. 12. another further aspect of the second version of the present invention is observed, in which the brick is characterized by two cavities (34) of negative geometry located on the inferior horizontal surface (2) in direction of the Y axis, wherein said cavities (34) interlock precisely with vertically adjacent blocks with the protuberances (33) of the superior horizontal surface (1).

The negative geometry of the cavities (34) can be any appropriate geometry form. The preferred negative geometry, as it is observed in FIG. 12., is represented by two cavities (34) of concave-cylindrical geometry located on the inferior horizontal surface (2) in direction of the Y axis, wherein said cavities (34) interlock precisely with vertically adjacent blocks with the protuberances (33) of the superior horizontal surface (1); and wherein the diameter of the aperture (37) of each cavity (34) on the brick's inferior horizontal surface (2) is equal to the diameter (38) of the cylindrical part of the cavity (34) of the cavity (34).

In FIGS. 10.-12. another aspect of the second version of the present invention is observed, in which the brick is characterized by two cylindrical holes (39) that perforate entirely the brick, wherein the span of said holes (39), in direction of an inclination angle (40) (FIG. 12.) between 1° and 45° in relation to the Y axis, is defined from the superior border (41) of the positive geometry of the protuberances (33) of the superior horizontal surface (1) to the superior border (42) of the negative geometry of the cavities (34) of the inferior horizontal surface (2); and wherein said holes (39) and the identical holes (39) of the vertically adjacent blocks in a wall are aligned in direction of an equal inclination angle in the wall, to form continuous inclined holes that go throughout the height of the wall; and wherein said holes have a diameter that fits the diameter of a rod such that the rod can be introduced through the continuous hole that goes throughout the height of the wall; and wherein resistant interlocks are created between the vertically and horizontally adjacent bricks to build a wall that allows the introduction of a skeleton constituted by a plurality of rods, thus resulting in a structure with great rigidity and lateral resistance, and great resistance to extreme uniform, cyclic and gravitational forces.

The two versions that have been described of the system of brick with rod of the present invention, are adequate for the construction of inclined walls for retaining walls.

Figure 17:
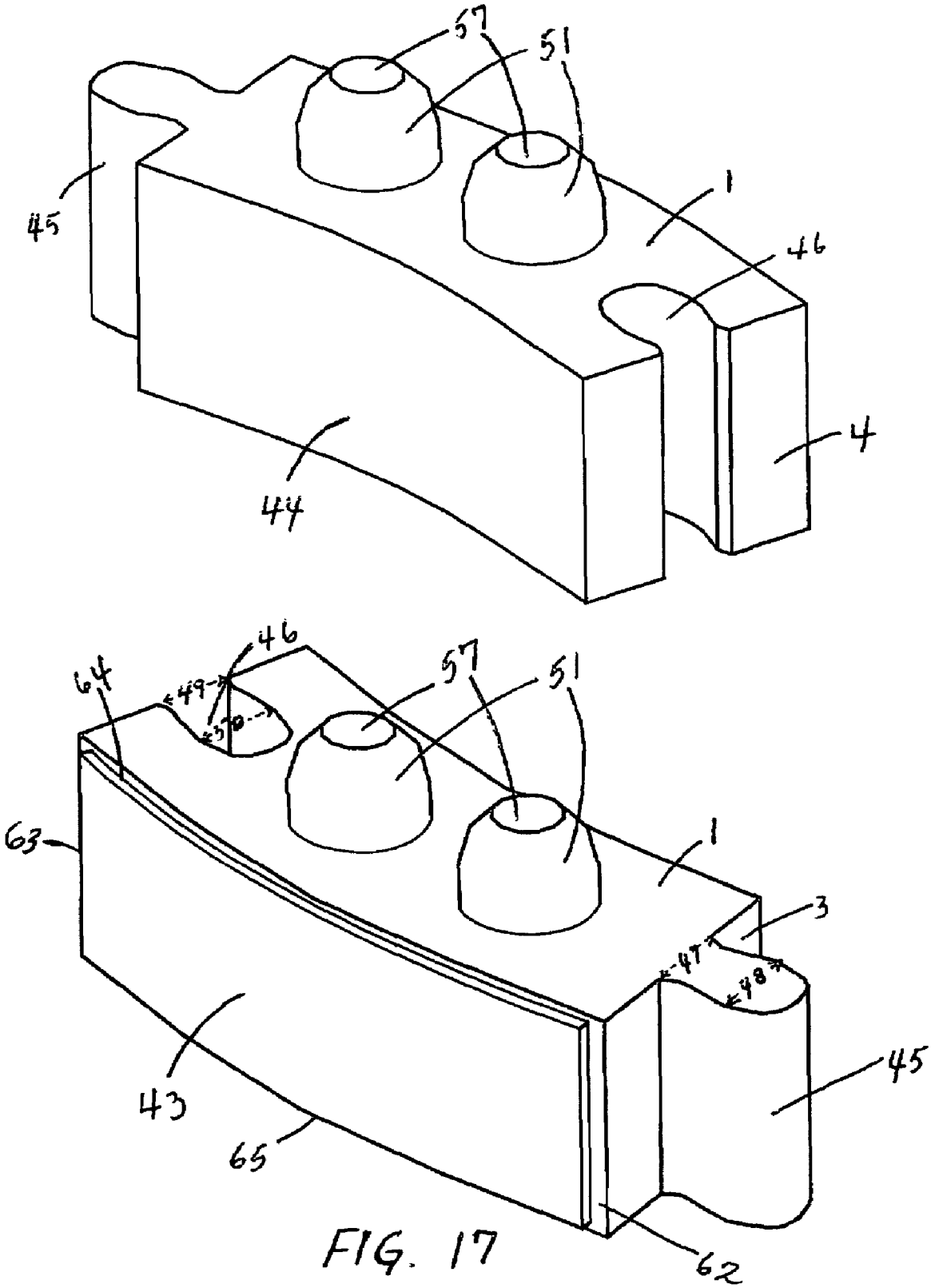
FIG. 17. is a tridimensional view of two embodiments of the third version of the brick of the present invention.

In FIGS. 17.-19 a third version of the present invention is shown, wherein the brick is a tridimensional block for the construction of walls; and wherein the block is characterized by two lateral vertical surfaces (43 and 44) (FIG. 17.) defined by the X and Y axis; and wherein the first lateral vertical surface (43) (FIG. 17.) is a convex surface; and wherein the second lateral vertical surface (44) is a concave surface; and wherein the first vertical surface (43) and the second vertical surface (44) are parallel.

In FIGS. 17.-18. another aspect of the third version of the present invention is observed, in which the brick is characterized by a symmetrical protuberance (45) of positive geometry that is originated on the middle of the brick's anterior vertical surface (3) (FIG. 17.) in direction of the X axis, wherein said protuberance (45) interlocks precisely with a horizontally adjacent block with the cavity (46) of the vertical posterior surface (4).

The positive geometry of the protuberance (45) can be any appropriate geometry form. The preferred positive geometry, as it is observed in FIGS. 17.-18., is represented by a symmetrical protuberance (45) of rounded convex geometry that is originated on the middle of the brick's anterior vertical surface (3) in direction of the X axis, wherein said protuberance (45) interlocks precisely with a horizontally adjacent block with the cavity (46) of the vertical posterior surface (4); and wherein the base (47) (FIG. 17.) of the protuberance (45) on the brick's vertical anterior surface (3), defined in the same direction of the Z axis, is of less span than the maximum diameter (48) (FIG. 17.) of the convex geometry of the protuberance (45).

In FIGS. 17.-18. another aspect of the third version of the present invention is also observed, in which the brick is characterized by a cavity (46) of negative geometry that is originated on the middle of the brick's vertical posterior surface (4) in direction of the X axis, wherein said cavity (46) interlocks precisely with a horizontally adjacent block with the protuberance (45) of the vertical anterior surface (3).

The negative geometry of the cavity (46) can be any appropriate geometry form. The preferred negative geometry, as it is observed in FIGS. 17.-18., is represented by a symmetrical cavity (46) of concave geometry that is originated on the middle of the brick's vertical posterior surface (4) in direction of the X axis, wherein said cavity (46) interlocks precisely with a horizontally adjacent block with the protuberance (45) of the vertical anterior surface (3); and wherein the span (49) (FIG. 17.) of the aperture of the cavity (46) on the brick's vertical posterior surface (3); defined in the same direction of the Z axis, is less than the maximum diameter (50) (FIG. 17.) of the concave geometry of the cavity (46).

In FIGS. 17., 18. y 20. another additional aspect of the third version of the present invention is observed, in which the brick is characterized by two protuberances (51) of positive geometry located symmetrically on the middle of the brick's superior horizontal surface (1) in direction of the Y axis, wherein said protuberances (51) interlock precisely with vertically adjacent blocks with the cavities (52) (FIG. 20.) of the inferior horizontal surface (2);

The positive geometry of the protuberances (51) can be any appropriate geometry form. The preferred positive geometry, as it is observed in FIGS. 17.-18.and 20., is represented by two protuberances (51) of convex-cylindrical geometry located symmetrically on the middle of the brick's superior horizontal surface (1) in direction of the Y axis, wherein said protuberances (51) interlock precisely with vertically adjacent blocks with the cavities (52) of the inferior horizontal surface (2); and wherein the diameter (53) (FIG. 20.) of the base of each protuberance (51) on the brick's superior horizontal surface (1) is more than or equal to the diameter of the cylindrical part (54) (FIG. 20.) of the protuberance (51).

Figure 20:
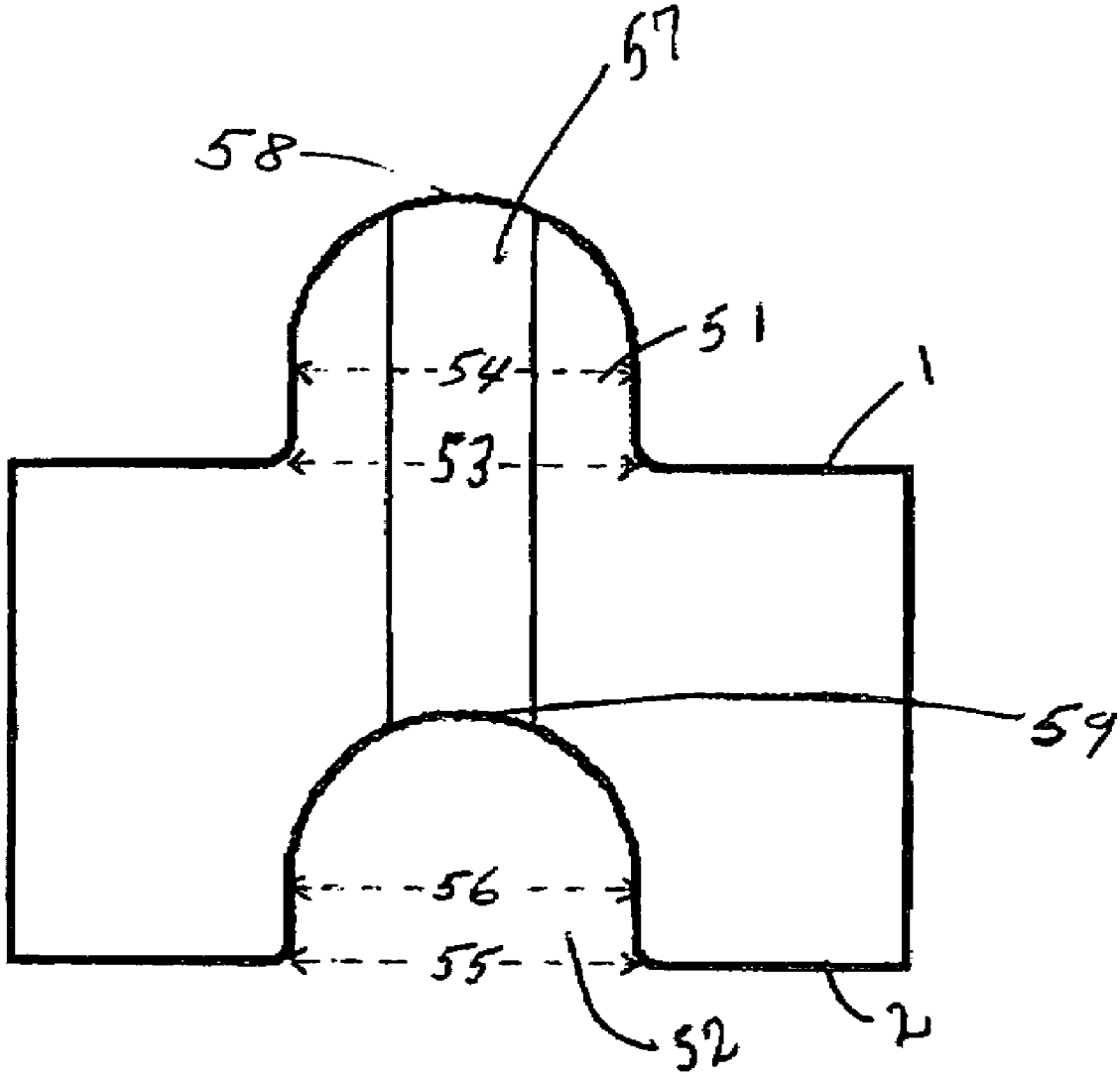
FIG. 20. shows a bi-dimensional view of a sagittal plane that cross at the level of one of the protuberances on the superior horizontal surface and one of the cavities on the inferior horizontal surface of the third version of the brick of the present invention.

In FIG. 20. another further aspect of the third version of the present invention, in which the brick is characterized by two cavities (52) of negative geometry located on the middle of the inferior horizontal surface (2) in direction of the Y axis, wherein said cavities (52) interlock precisely with vertically adjacent blocks with the protuberances (51) of the superior horizontal surface (1).

The negative geometry of the cavities (52) can be any appropriate geometry form. The preferred negative geometry, as it is observed in FIG. 20., is represented by two cavities (52) of concave-cylindrical geometry located on the middle of the inferior horizontal surface (2) in direction of the Y axis, wherein said cavities (52) interlock precisely with vertically adjacent blocks with the protuberances (51) of the superior horizontal surface (1); and wherein the aperture's diameter (55) of each cavity (52) on the brick's inferior horizontal surface (2) is more than or equal to the diameter (56) of the cylindrical part of the cavity (52).

In FIGS. 17.-20. another aspect of the third version of the present invention, in which the brick is characterized by two vertical cylindrical holes (57) that perforate entirely the brick, wherein the span of said holes (57), in direction of the Y axis, is defined from the superior border (58) (FIG. 20.) of the positive geometry of the protuberances (51) of the superior horizontal surface (1) to the superior border (59) (FIG. 20.) of the negative geometry of the cavities (52) of the inferior horizontal surface (2); and wherein said holes (57) and the identical holes (57) of the vertically adjacent bricks in a wall are aligned in direction of the vertical axis in the wall to form continuous vertical holes that go throughout the height of the wall; and wherein resistant interlocks are created between the vertically and horizontally adjacent bricks to build a wall with great rigidity and lateral resistance, and great resistance to extreme uniform, cyclic, and gravitational forces.

In FIG. 20. another further aspect of the third version of the present invention is observed, in which the brick is characterized by two vertical cylindrical holes (57) that perforate entirely the brick, wherein the span of said holes (57), in direction of the Y axis, is defined from the superior border (58) of the positive geometry of the protuberances (51) of the superior horizontal surface (1) to the superior border (59) of the negative geometry of the cavities (52) of the inferior horizontal surface (2); and wherein said holes (57) and the identical holes (57) of the vertically adjacent bricks are aligned in direction of the vertical axis in a wall to form continuous vertical holes that go throughout the height of the wall; and wherein said holes have a diameter that fit the diameter of identical rods such that the rods can be introduced through the continuous holes that go throughout the height of the wall; and wherein resistant interlocks are created between the vertically and horizontally adjacent bricks for the construction that allows the introduction of a skeleton constituted by a plurality of vertical rods; and wherein said wall is a structure with great rigidity and lateral resistance, and great resistance to extreme uniform, cyclic, and gravitational forces.

Figure 18:
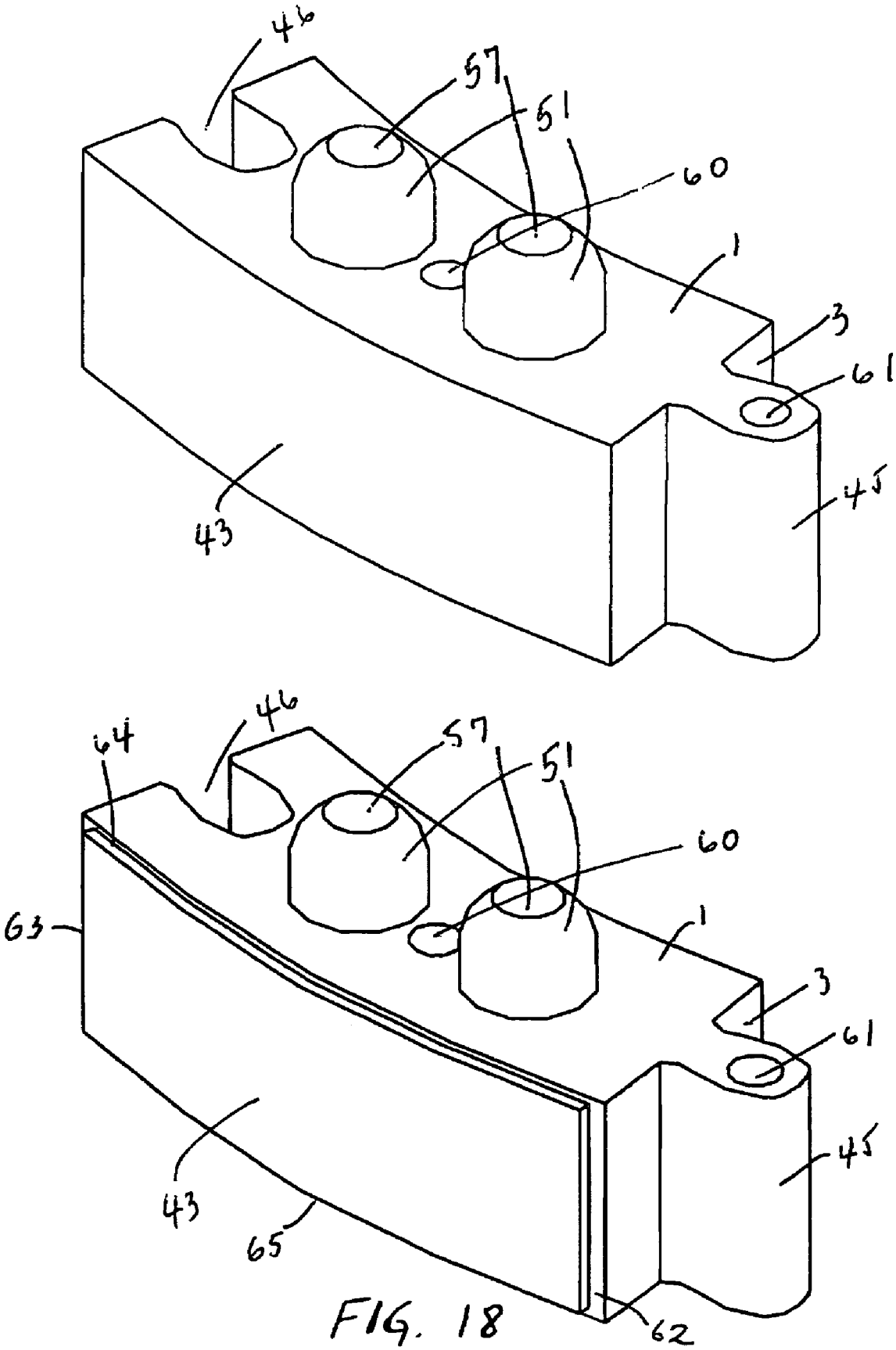
FIG. 18. is a tridimensional view of two embodiments of the third version of the brick of the present invention.
Figure 19:
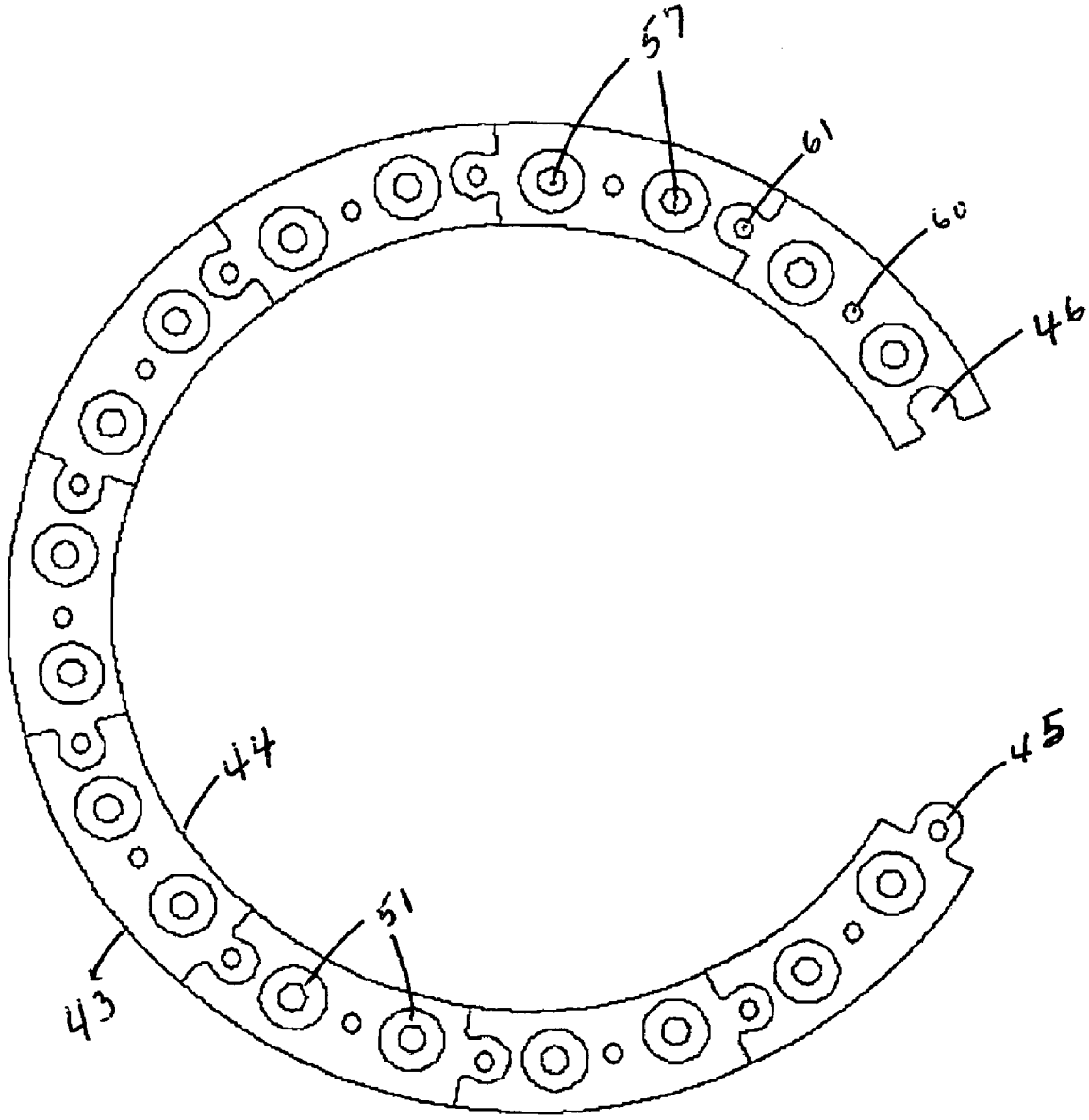
FIG. 19. shows a bi-dimensional view of a plane that cross at the transversal level a wall built with the third version of the present invention.

In FIGS. 18. y 19. another further aspect of the third version of the present invention is observed, in which the brick is characterized by two additional holes (60 y 61), wherein the first (60) of these two additional holes is a cylindrical hole that perforates entirely the brick, wherein the span of the first additional hole (60), in direction of the Y axis, is defined from the brick's superior horizontal surface (1) to the brick's inferior horizontal surface (2); and wherein the first additional hole (60) is located in parallel between the two holes (57) that go from the protuberances (51) of the superior horizontal surface (1) and the cavities (52) of the inferior horizontal surface (2); and wherein the second (61) of these two additional holes is a vertical cylindrical hole that perforates entirely, in direction of the Y axis, the protuberance (45) of the vertical anterior surface (3), where the span of the second additional hole (61) is defined from the center of the superior horizontal surface (1) of the protuberance (45) of the vertical anterior surface (3), to the center of the inferior horizontal surface (2) of the protuberance (45) of the vertical anterior surface (3); and wherein the first additional hole (60) and the second additional hole (61) have equal diameter, and wherein the first additional hole (60) and the second additional hole (61) of vertically adjacent bricks are aligned in direction of a vertical axis in a wall, to form a continuous vertical hole that goes throughout the height of the wall; and wherein these two additional holes have a diameter that fit the diameter of identical rods such that the rods can be introduced through the continuous holes that go throughout the height of the wall; and wherein resistant interlocks are created between the vertically and horizontally adjacent bricks to build a wall that allows the introduction of a skeleton constituted by a plurality of vertical rods; and wherein said wall is a structure with great rigidity and lateral resistance, and great resistance to extreme uniform, cyclic, and gravitational forces.

In FIGS. 17. y 18. another further aspect of the third version of the present invention is observed, in which the brick is characterized by a 90 degree right angle channel (62) on the two edges, in direction of the Y axis, of the vertical anterior surface (3); a 90 degree right angle channel (63) on the two edges, in direction of the Y axis, of the vertical posterior surface (4); a 90 degree right angle channel (64) on the two edges, in direction of the X axis, of the superior horizontal surface (1); and a 90 degree right angle channel (65) on the two edges, in direction of the X axis, of the inferior horizontal surface (2).

The brick of the third version of the present invention is appropriate for the contraction of curved walls.

One of the advantages of the system of brick with rod of the present invention is that in addition to the three preferred versions mentioned so far, the present invention also includes bricks with only one pair of holes of equal diameter.

Said diameter must fit the diameter of a rod. In the case of a single pair of holes, said holes can be like the pair of holes that go from the protuberances on the superior horizontal surface to the cavities on the inferior horizontal surface, or like the pair of holes wherein one hole goes from the middle of the superior horizontal surface to the middle of the inferior horizontal surface, and wherein the other hole goes along the protuberance of the vertical anterior surface from the superior horizontal surface to the inferior horizontal surface.

While the description presents the preferred embodiments of the present invention, additional changes can be made in the form and disposition of the parts without distancing from the basic ideas and principles comprised in the following claims:

The invention claimed is:

1. A system of brick and rod, wherein the brick is tridimensional and rectangular, and is defined by the three Cartesian coordinates X, Y, Z, wherein the horizontal axis X defines length, the vertical axis Y defines height, the horizontal axis Z defines width, and wherein the brick is a solid block comprising:

a. a superior horizontal surface and a inferior horizontal surface defined by the X and Z axis;

b. a vertical anterior surface and a vertical posterior surface defined by the Z and Y axis;

c. two vertical lateral surfaces defined by the X and Y axis;

d. a protuberance of positive geometry that is originated on the brick's vertical anterior surface in direction of the X axis, and with an axis between the superior horizontal surface and the inferior horizontal surface with an inclination angle between 1° and 45° in relation to the Y axis, wherein said protuberance interlocks precisely with an horizontally adjacent block with the cavity described in e.;

e. a cavity of negative geometry that is originated on the brick's vertical posterior surface in direction of the X axis, and with an axis between the superior horizontal surface and the inferior horizontal surface with an inclination angle between 1° and 45° in relation to the Y axis, wherein said cavity interlocks precisely with an horizontally adjacent brick with the protuberance described in d., f. two protuberances of positive geometry located on the brick's superior horizontal surface in direction of an axis with an inclination angle between 1° and 45° in relation to the Y axis, wherein said protuberances interlock precisely with vertically adjacent blocks with the cavities described in g.;

g. two cavities of negative geometry located symmetrically on the inferior horizontal surface in direction of an axis with an inclination angle between 1° and 45° in relation to the Y axis, wherein said cavities interlock precisely with vertically adjacent blocks with the protuberances described in f.;

h. two cylindrical holes which perforate entirely the brick, wherein the span of said holes, in direction of an axis with an inclination angle between 1° and 45° in relation to the Y axis, is defined from the superior border of the positive geometry of the protuberances described in f. to the superior border of the negative geometry of the cavities described in g.; and wherein these holes and the identical holes of vertically adjacent brick's in a wall are aligned in direction of an axis with an equal inclination angle in the wall, to form inclined continuous holes that go throughout the height of the wall; and wherein said holes have a diameter which fits the diameter of a rod such that the rod can be introduced through the continuous hole that goes throughout the height of the wall;

and wherein resistant interlocks are created between vertically and horizontally adjacent bricks to build an inclined wall which allows the introduction of an skeleton constituted by a plurality of rods thus resulting in a structure with great rigidity and lateral resistance, and great resistance to extreme uniform, cyclic and gravitational forces.

2. The system according to claim 1, wherein the brick has two additional holes, wherein the first of these two additional holes is a cylindrical hole which perforates entirely the brick, wherein the span of the first additional hole, in direction of an axis with an inclination angle between 1° and 45° in relation to the Y axis, is defined from the brick's superior horizontal surface to the brick's inferior horizontal surface; and wherein the first additional hole is located in parallel between the two holes described in 1.h.; and wherein the second of these additional two holes is a vertical cylindrical hole which perforates entirely, in direction of an axis with an inclination angle between 1° and 45° in relation to the Y axis, the protuberance described in 1.d., wherein the span of the second additional hole is defined from the center of said protuberance's superior horizontal surface to the center of said protuberance's inferior horizontal surface; and wherein the first additional hole and the second additional hole are of equal diameter, and wherein the first additional hole and the second additional hole of vertically adjacent bricks are aligned in direction of an axis with an equal inclination axis in a wall, to form an inclined continuous hole that goes throughout the height of a the wall; and wherein these two additional holes have a diameter that fits the diameter of a rod such that the rod can be introduced through the continuous hole that goes throughout the height of the wall.

3. The system, according to claim 1, wherein the rod has a span that is equal or exceeds the span of the wall's height; and wherein the rod is vertically introduced through the continuous holes of the wall.

4. The system, according to claim 1, wherein the rod is a composed rod that comprises rod fragments; wherein each rod fragment's span is equal to one and a half times the span of the brick's height, and wherein each rod fragment is formed by three parts defined as first part, second part and a third part; wherein the three parts have exactly the same span such that each part has a span equal to one third the span of rod fragment; wherein the first part is at one rod fragment's end; and wherein the first part is hollow with internal thread thus constituting the part that functions as female screw of the rod fragment; and wherein the second part is the middle of the rod fragment between the first part and the third part; and wherein the second part is solid; and wherein the third part is solid with external thread; and wherein the third part is located at the end opposite to the end constituted by the first part; and wherein the third part is the part that functions as male screw of the rod fragment; and wherein the first part of a rod fragment interlocks with the third part of another identical rod fragment, and wherein a plurality of identical rod fragments that have successively been interlocked form the composed rod.

5. The system, according to claim 1, wherein the rod is a composed rod that comprises rod fragments; wherein each rod fragment's span is equal to one and a half times the span of the brick's height, and wherein each rod fragment is formed by three parts defined as first part, second part and a third part; wherein the three parts have exactly the same span such that each part has a span equal to one third the span of the rod fragment; wherein the first part is at one rod fragment's end; and wherein the first part is hollow with an internal diameter that fits the external diameter of the third part; and wherein the first part is the female part of the rod fragment; and wherein the second part is in the middle of the rod fragment between the first part and the third part; and wherein the second part is solid; and wherein the third part is solid with an external diameter that fits the internal diameter of the first part; and wherein the third part is located at the end opposite to the end constituting the first part; and wherein the third part is the male part of the rod fragment; and wherein the first part of a rod fragment interlocks with the third part of another identical rod fragment, and wherein a plurality of identical rod fragments that have successively been interlocked form the composed rod.

6. A system of brick and rod, wherein the brick is tridimensional and rectangular and is defined by the three Cartesian coordinates X, Y, Z, wherein the horizontal axis X defines length, the vertical axis Y defines height, the horizontal axis Z defines width, and wherein the brick is a solid block comprising:

a. a superior horizontal surface and a inferior horizontal surface defined by the X and Z axis;

b. a vertical anterior surface and a vertical posterior surface defined by the Z and Y axis;

c. two vertical lateral surfaces defined by the X and Y axis;

d. a protuberance of positive geometry that is originated on the middle of the brick's vertical anterior surface in direction of the X axis, wherein said protuberance interlocks precisely with an horizontally adjacent block with the cavity described in e.;

e. a cavity of negative geometry which is originated on the middle of the brick's vertical posterior surface in direction of the X axis, wherein said cavity interlocks precisely with a horizontally adjacent block with the protuberance described in d.;

f. two protuberances of positive geometry located on the brick's superior horizontal surface in direction of the Y axis, wherein said protuberances interlock precisely with vertically adjacent blocks with the cavities described in g.;

g. two cavities of negative geometry located on the inferior horizontal surface in direction of the Y axis, wherein said cavities interlock precisely with vertically adjacent blocks with the protuberances described in f.;

h. two cylindrical holes that perforate entirely the brick, wherein the span of said holes, in direction of an axis with an inclination angle between 1° and 45° in relation to the Y axis, is defined from the superior border of the positive geometry of the protuberances describe in f. to the superior border of the negative geometry of the cavities describe in g.; and wherein these holes and the identical holes of the vertically adjacent bricks in a wall are aligned in direction of an axis with an equal inclination angle in the wall, to form continuous inclined holes that go throughout the height of the wall; and wherein said holes have a diameter that fits the diameter of a rod such that the rod can be introduced through the continuous hole that goes throughout the height of the wall;

and wherein resistant interlocks are created between the vertically and horizontally adjacent bricks to build a wall that allows the introduction of a skeleton constituted by a plurality of rods thus resulting in a structure with great rigidity and lateral resistance, and great resistance to extreme uniform, cyclic, and gravitational forces.

7. The system, according to claim 6, wherein the rod has a span that is equal or exceeds the span of the wall's height; and wherein the rod is vertically introduced through the continuous holes of the wall.

8. The system, according to claim 6, wherein the rod is a composed rod that comprises rod fragments; wherein each rod fragment's span is equal to one and a half times the span of the brick's height, and wherein each rod fragment is formed by three parts defined as first part, second part and a third part; wherein the three parts have exactly the same span such that each part has a span equal to one third the span of the rod fragment; wherein the first part is at one rod fragment's end; and wherein the first part is hollow with internal thread thus constituting the part that functions as female screw of the rod fragment; and wherein the second part is the middle of the rod fragment between the first part and the third part; and wherein the second part is solid; and wherein the third part is solid with external thread; and wherein the third part is located at the end opposite to the end constituted by the first part; and wherein the third part is the part that functions as male screw of the rod fragment; and wherein the first part of a rod fragment interlocks with the third part of another identical rod fragment, and wherein a plurality of identical rod fragments that have successively been interlocked form the composed rod.

9. The system, according to claim 6, wherein the rod is a composed rod that comprises rod fragments; wherein each rod fragment's span is equal to one and a half times the span of the brick's height, and wherein each rod fragment is formed by three parts defined as first part, second part and a third part; wherein the three parts have exactly the same span such that each part has a span equal to one third the span of the rod fragment; wherein the first part is at one rod fragment's end; and wherein the first part is hollow with an internal diameter that fits the external diameter of the third part; and wherein the first part is the female part of the rod fragment; and wherein the second part is in the middle of the rod fragment between the first part and the third part; and wherein the second part is solid; and wherein the third part is solid with an external diameter that fits the internal diameter of the first part; and wherein the third part is located at the end opposite to the end constituting the first part; and wherein the third part is the male part of the rod fragment; and wherein the first part of a rod fragment interlocks with the third part of another identical rod fragment, and wherein a plurality of identical rod fragments that have successively been interlocked form the composed rod.

* * * * *